US010864726B2

(12) United States Patent
Miyazawa et al.

(10) Patent No.: US 10,864,726 B2
(45) Date of Patent: Dec. 15, 2020

(54) LIQUID EJECTING HEAD AND LIQUID EJECTING APPARATUS

(71) Applicant: Seiko Epson Corporation, Tokyo (JP)

(72) Inventors: Hiromu Miyazawa, Azumino (JP); Toshihiro Shimizu, Fujimi (JP)

(73) Assignee: Seiko Epson Corporation

( * ) Notice: Subject to any disclaimer, the term of this patent is extended or adjusted under 35 U.S.C. 154(b) by 2 days.

(21) Appl. No.: 16/351,658

(22) Filed: Mar. 13, 2019

(65) Prior Publication Data

US 2019/0283421 A1 Sep. 19, 2019

(30) Foreign Application Priority Data

Mar. 14, 2018 (JP) ..... 2018-046862

(51) Int. Cl.
*B41J 2/14* (2006.01)
*B41J 2/045* (2006.01)

(52) U.S. Cl.
CPC ..... *B41J 2/14201* (2013.01); *B41J 2/04581* (2013.01); *B41J 2/14233* (2013.01); *B41J 2002/14338* (2013.01); *B41J 2002/14419* (2013.01); *B41J 2202/11* (2013.01)

(58) Field of Classification Search
CPC ..... B41J 2/14233; B41J 2/04581; B41J 2002/14338; B41J 2002/14459; B41J 2202/12; F04B 43/046
See application file for complete search history.

(56) References Cited

U.S. PATENT DOCUMENTS

2005/0123420 A1* 6/2005 Richter ..... F04B 43/043 417/413.2
2005/0219280 A1* 10/2005 Hiwada ..... B41J 2/04551 347/5
2008/0079759 A1 4/2008 Nagashima
2011/0063350 A1* 3/2011 Kusunoki ..... B41J 2/175 347/11
2011/0069118 A1 3/2011 Ohzeki et al.
2011/0134174 A1* 6/2011 Seto ..... B41J 2/04588 347/10
2014/0078224 A1 3/2014 Park et al.

FOREIGN PATENT DOCUMENTS

JP 4806617 B2 11/2011
JP 5430316 B2 2/2014
JP 2014-061695 A 4/2014

* cited by examiner

*Primary Examiner* — John Zimmermann
(74) *Attorney, Agent, or Firm* — Harness, Dickey & Pierce, P.L.C.

(57) ABSTRACT

A liquid ejecting head includes: a nozzle from which a liquid is ejected; a communication passage that is in communication with the nozzle; a first pressure compartment that is connected to the communication passage through a first passage; a second pressure compartment that is connected to the communication passage through a second passage; a first drive element that changes pressure of the first pressure compartment; and a second drive element that changes pressure of the second pressure compartment.

18 Claims, 17 Drawing Sheets

LIQUID EJECTING HEAD AND LIQUID EJECTING APPARATUS

BACKGROUND

1. Technical Field

Embodiments of the present disclosure relate to a technique for ejecting liquid such as ink.

2. Related Art

A liquid ejecting head that ejects a liquid such as ink out of a pressure compartment through a nozzle by operating a drive element such as a piezoelectric element is known. For example, a head disclosed in JP-A-2014-061695 has the following structure. A first pressure compartment, which is in communication with a first common passage, and a second pressure compartment, which is in communication with a second common passage, are arranged in series. Ink is supplied from an ink supply unit to the first common passage. Ink is discharged to an ink collection unit from the second common passage. There is a hole formed in a wall between the first pressure compartment and the second pressure compartment. This structure produces a circulating flow of ink (liquid) that is supplied from the first common passage, moves from the first pressure compartment to the second pressure compartment through the hole, and is discharged to the second common passage. In JP-A-2014-061695, a filter and a deaerator for removing air bubbles and foreign substances contained in the circulating ink are provided at a communication portion via which the first common passage and the second common passage are in communication with each other.

In JP-A-2014-061695, the wall is formed between the first pressure compartment and the second pressure compartment for the purpose of preventing a backflow of the ink from the second pressure compartment to the first pressure compartment during an operation for ejecting, from the nozzle, the ink that has moved into the second pressure compartment from the first pressure compartment. Moreover, since the second pressure compartment is in communication with the second common passage, a part of the ink in the second pressure compartment is discharged to the second common passage without being ejected from the nozzle. Therefore, if the structure disclosed in JP-A-2014-061695 is employed, it is difficult to discharge ink whose amount is greater than the capacity (volume) of either one of the first pressure compartment and the second pressure compartment.

SUMMARY

A liquid ejecting head according to a preferred aspect (first aspect) of the present disclosure includes: a nozzle from which a liquid is ejected; a communication passage that is in communication with the nozzle; a first pressure compartment that is connected to the communication passage through a first passage; a second pressure compartment that is connected to the communication passage through a second passage; a common liquid chamber that communicates the first pressure compartment and the second pressure compartment with each other and retains the liquid that is to be ejected from the nozzle; a first drive element that changes pressure of the first pressure compartment; and a second drive element that changes pressure of the second pressure compartment.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
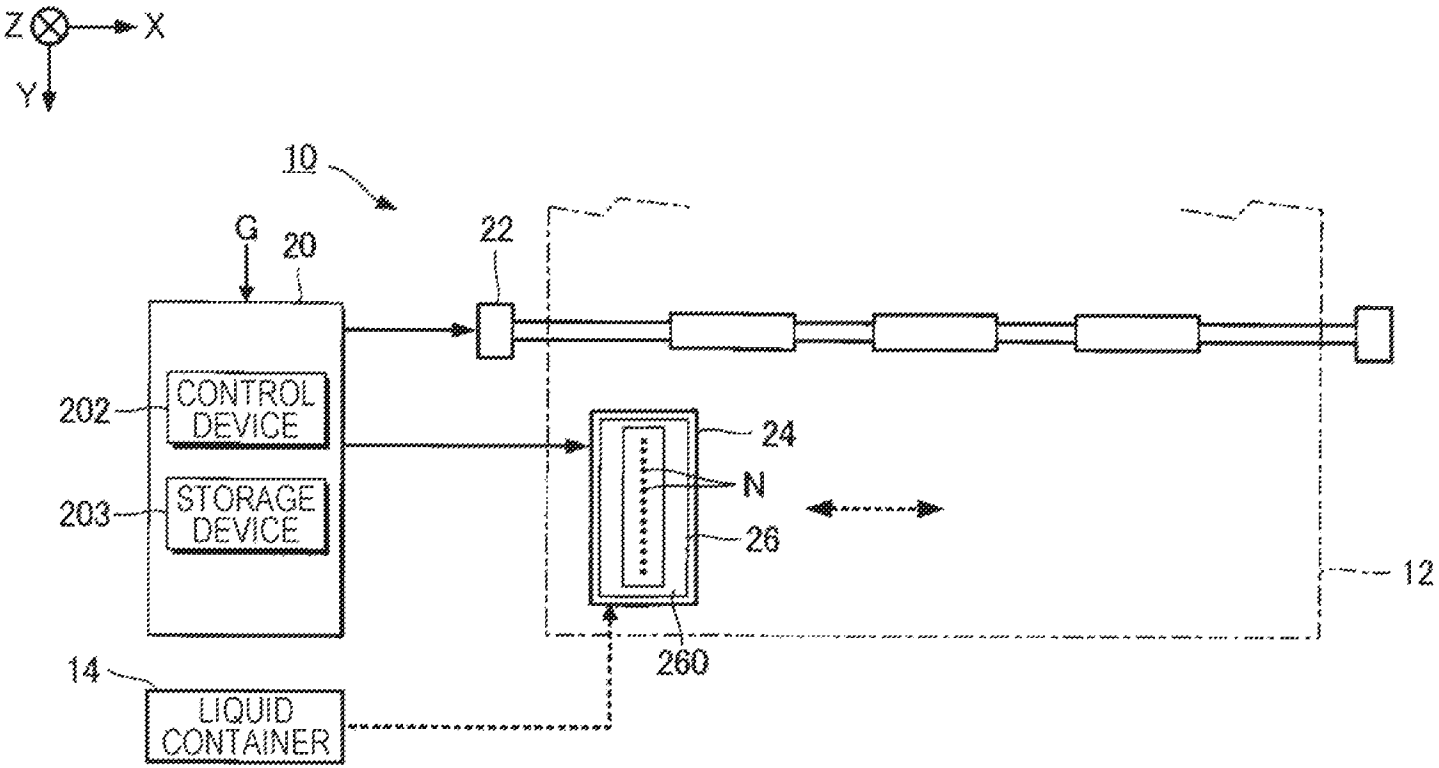
FIG. 1 is a configuration diagram of a liquid ejecting apparatus according to a first embodiment of the present disclosure.

FIG. 1 is a partial configuration diagram of a liquid ejecting apparatus 10 according to a first embodiment of the present disclosure. The liquid ejecting apparatus 10 of the present embodiment is an ink-jet-type printing apparatus that ejects ink, which is an example of a liquid, onto a medium 12. A typical example of the medium 12 is printing paper. The medium 12, which is the target of printing, may be made of other material, for example, a resin film, a cloth, to name but a few. The liquid ejecting apparatus 10 illustrated in FIG. 1 includes a control unit 20, a transport mechanism 22, a carriage 24, and a liquid ejecting head 26. In the illustrated example of FIG. 1, a single liquid ejecting head 26 is mounted on the carriage 24. However, its structure is not limited to the illustrated example. Two or more liquid ejecting heads 26 may be mounted on the carriage 24. A liquid container 14 (cartridge) that contains ink is on the liquid ejecting apparatus 10.

The liquid container 14 is an ink-tank-type cartridge formed of a box-shaped container detachably attached to the body of the liquid ejecting apparatus 10. The liquid container 14 is not limited to a box-shaped container. The liquid container 14 may be an ink-pack-type cartridge that is a bag-shaped container. An ink tank that can be replenished with ink may be used as the liquid container 14. The ink contained in the liquid container 14 may be black ink or color ink. The ink contained in the liquid container 14 is supplied (pressure-fed) to the liquid ejecting head 26 by a pump (not illustrated).

The control unit 20 includes, for example, a control device 202 such as a central processing unit (CPU) or a field programmable gate array (FPGA) and a storage device 203 such as semiconductor memory. For central control on each component of the liquid ejecting apparatus 10, the control device 202 runs control programs stored in the storage device 203. As illustrated in FIG. 1, print data G, which represents an image that is to be formed on the medium 12, is supplied to the control unit 20 from an external device (not illustrated) such as a host computer. The control unit 20 controls each component of the liquid ejecting apparatus 10 so as to form an image on the medium 12 as specified by the print data G.

The transport mechanism 22 transports the medium 12 in the Y direction under the control of the control unit 20. The liquid ejecting head 26 is mounted on the carriage 24, which has a shape like a box. Under the control of the control unit 20, the liquid ejecting head 26 ejects ink supplied from the liquid container 14 onto the medium 12. The control unit 20 reciprocates the carriage 24 in the X direction (which is an example of a first direction) orthogonal to the Y direction (which is an example of a second direction). Concurrently with the transportation of the medium 12 by the transport mechanism 22 and the repetitive reciprocating motion of the carriage 24, the liquid ejecting head 26 ejects ink onto the medium 12, thereby forming an image on the surface of the medium 12 in accordance with instructions. The liquid container 14 may be mounted in addition to the liquid ejecting head 26 on the carriage 24.

The liquid ejecting head 26 has an ejecting surface 260 (facing toward the medium 12). The ejecting surface 260 has a nozzle array. The nozzle array is a set of nozzles N arranged linearly in the Y direction. Ink supplied from the liquid container 14 is ejected from the nozzles N. The number of nozzles in the array, and the arrangement pattern of them, is not limited to the illustrated example. Two or more rows of nozzles may be arranged in the ejecting surface 260 of the liquid ejecting head 26. Zigzag arrangement or staggered arrangement, etc. may be adopted for such rows of nozzles. The direction perpendicular to the X-Y plane (i.e., plane parallel to the surface of the medium 12) is denoted as the Z direction.

Figure 2:
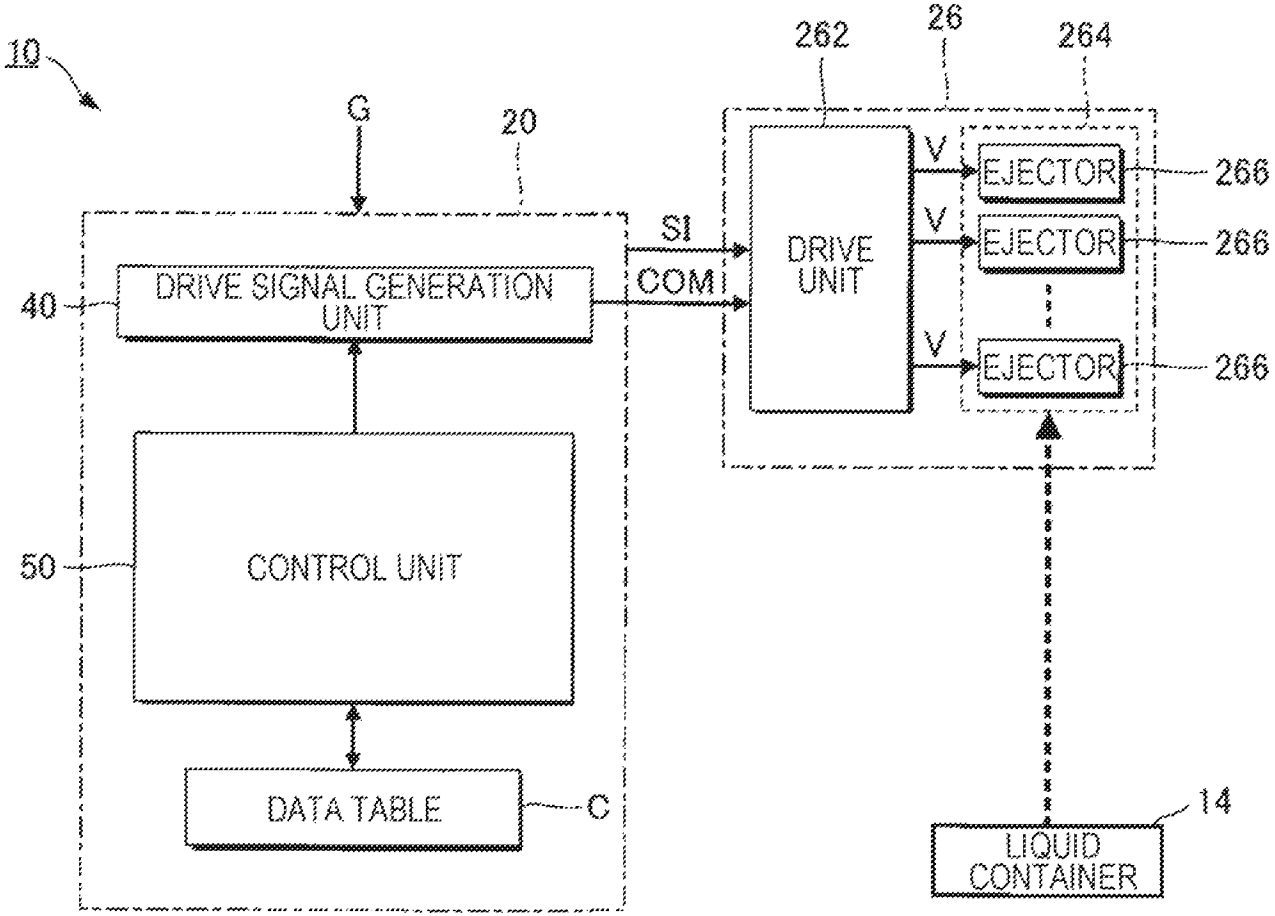
FIG. 2 is a functional configuration diagram of the liquid ejecting apparatus.

FIG. 2 is a functional configuration diagram of the liquid ejecting apparatus 10. For the sake of simplicity, the transport mechanism 22 and the carriage 24, etc. are not illustrated in FIG. 2. The control device 202 runs control programs. By running them, the control device 202 behaves as a drive signal generation unit 40 and a control unit 50. The control unit 50 controls the drive signal generation unit 40. A data table C is stored in the storage device 203.

Figure 8:
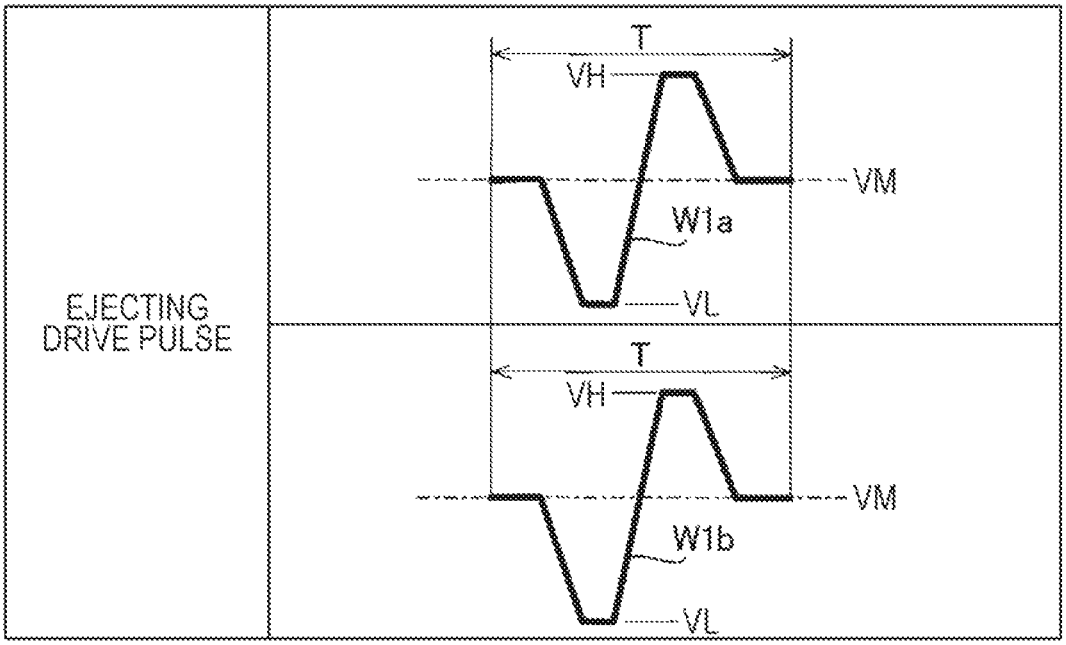
FIG. 8 is a diagram that illustrates ejecting drive pulses.
Figure 9:
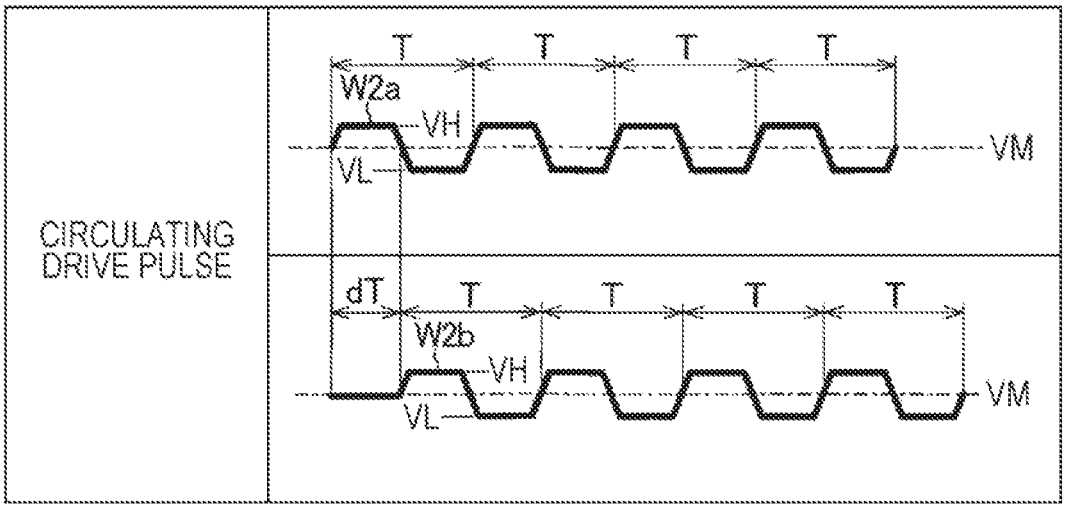
FIG. 9 is a diagram that illustrates circulating drive pulses.

The drive signal generation unit 40 generates a drive signal COM. The drive signal COM is a voltage signal that contains drive pulses (drive waveform) in a predetermined cycle. Specifically, for example, as illustrated in FIGS. 8 and 9, which will be described later, the drive signal COM is a voltage signal that has voltage levels with level differences from a reference potential VM. The waveform of the drive pulse may be set arbitrarily. For example, by changing the waveform of the drive pulse, it is possible to change the weight of an ink droplet ejected from the nozzle N. One cycle time T of the drive signal COM may contain a plurality of drive pulses. A plurality of drive signals COM whose waveforms differ from each other may be used. Data for generating the drive signal COM (for example, voltage level data) is stored in the data table C. When each drive signal COM is generated, the control unit 50 reads data corresponding to the waveform of the drive signal COM out of the data table C and causes the drive signal generation unit 40 to generate the drive signal COM.

As illustrated in FIG. 2, the liquid ejecting head 26 includes a drive unit 262 and a liquid ejecting unit 264. The drive unit 262 drives the liquid ejecting unit 264 under the control of the control unit 20. The liquid ejecting unit 264 ejects ink supplied from the liquid container 14 onto the medium 12 from the plurality of nozzles N. The liquid ejecting unit 264 includes a plurality of ejectors 266 (ejection segments) corresponding to the plurality of nozzles N. Each of the plurality of ejectors 266 is capable of ejecting ink from the nozzle N in accordance with a drive signal V supplied from the drive unit 262 and causing minute vibration to an extent that the ink of the ejector 266 is not ejected.

When ink is ejected in accordance with the print data G received by the control unit 20, the drive signal COM, which is generated by the drive signal generation unit 40 in accordance with the print data G, and a selection signal SI, which specifies whether or not to eject ink in accordance with the print data G, are supplied from the control unit 20 to the drive unit 262. For each of the plurality of ejectors 266, the drive unit 262 generates a drive signal V corresponding to the drive signal COM and the selection signal SI. Then, the drive unit 262 outputs the drive signals V to the plurality of ejectors 266 in parallel. Specifically, the drive unit 262 outputs the drive signal COM as the drive signal V to, among the plurality of ejectors 266, each ejector 266 for which the selection signal SI specifies ink ejection. The drive unit 262 outputs the reference potential VM as the drive signal V to, among the plurality of ejectors 266, each ejector 266 for which the selection signal SI specifies ink non-ejection.

Figure 3:
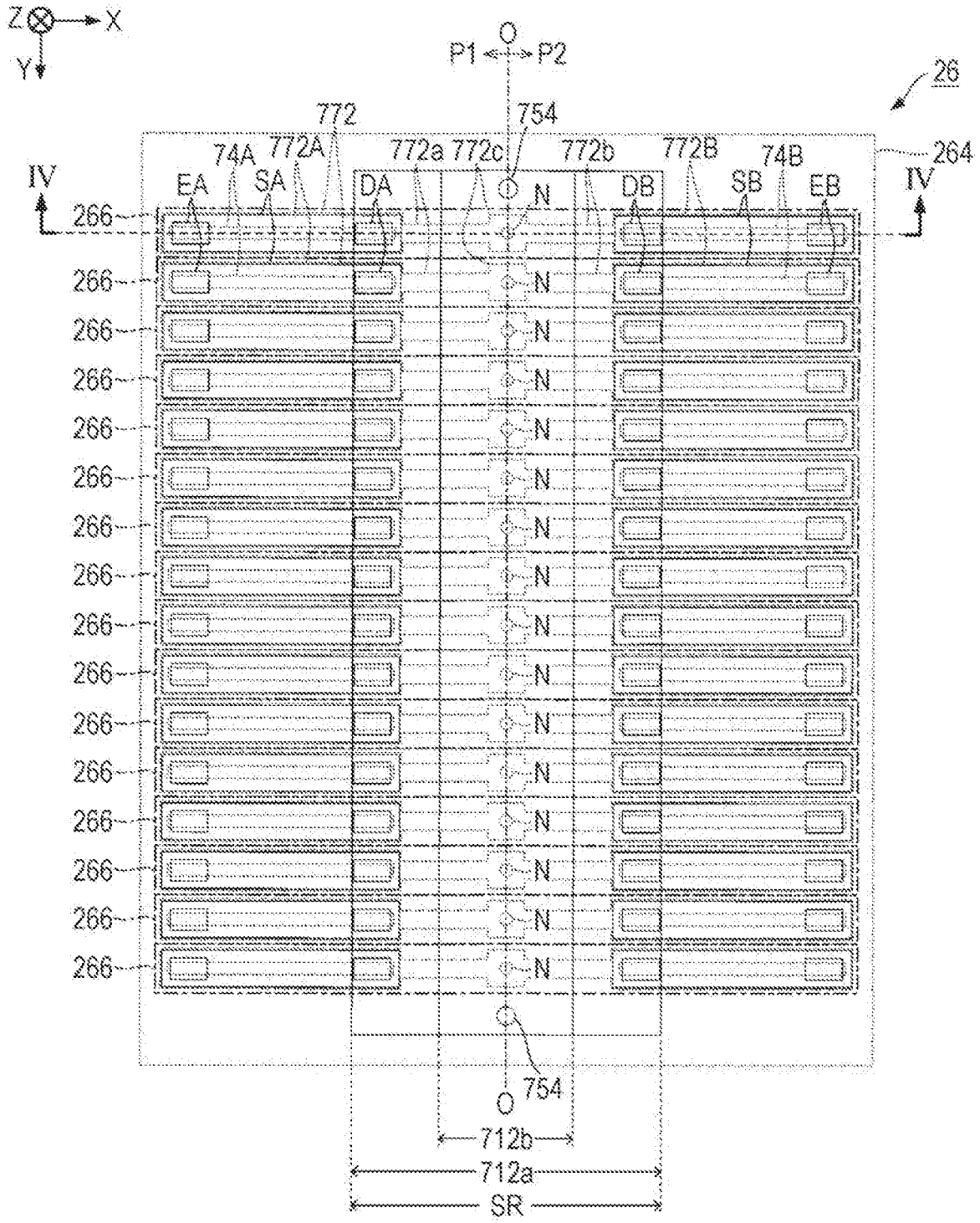
FIG. 3 is a schematic view of the passage structure of a liquid ejecting unit.
Figure 4:
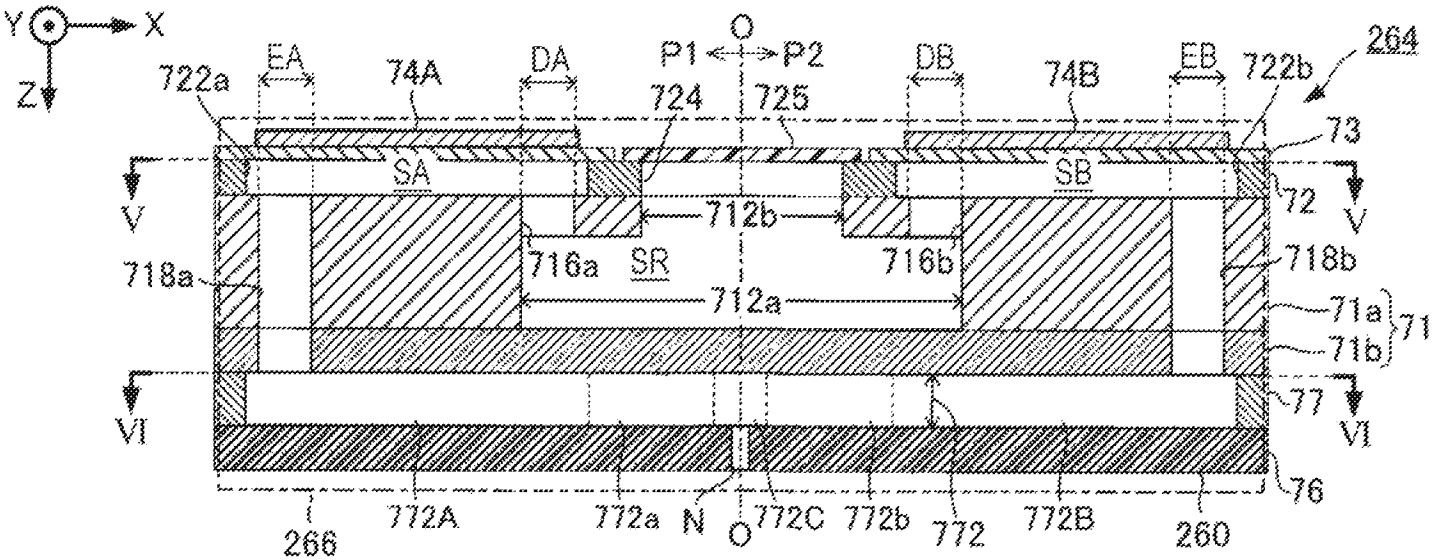
FIG. 4 is a sectional view of the liquid ejecting unit taken along the line IV-IV of FIG. 3.
Figure 5:
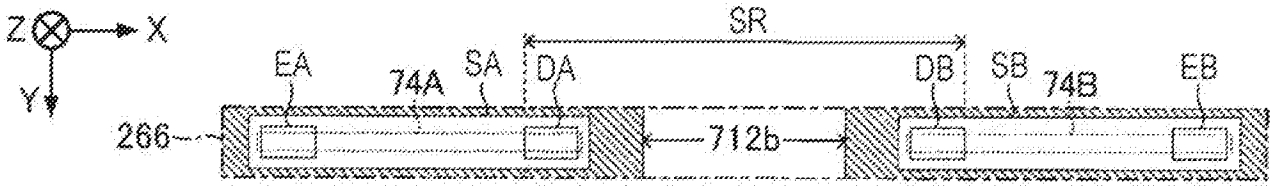
FIG. 5 is a sectional view of an ejector taken along the line V-V of FIG. 4.
Figure 6:
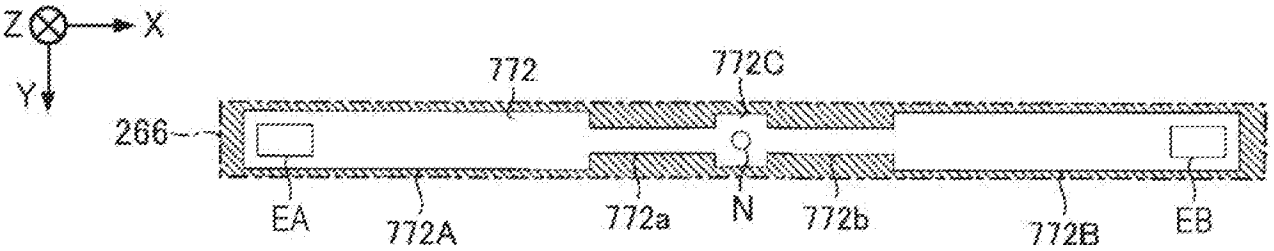
FIG. 6 is a sectional view of the ejector taken along the line VI-VI of FIG. 4.

FIG. 3 is a schematic view of the passage structure of the liquid ejecting unit 264, wherein the liquid ejecting head 26 is viewed from the negative side in the Z direction (the opposite side in relation to the medium 12). FIG. 4 is a sectional view of the liquid ejecting unit 264 taken along the line IV-IV of FIG. 3, wherein the structure of the liquid ejecting unit 264 with a focus on arbitrary one of the plurality of ejectors 266 is illustrated. FIG. 5 is a sectional view of the ejector 266 taken along the line V-V of FIG. 4. FIG. 6 is a sectional view of the ejector 266 taken along the line VI-VI of FIG. 4.

As illustrated in FIG. 3, the liquid ejecting unit 264 is substantially plane-symmetric with respect to a virtual plane O-O that is parallel to the Y-Z plane. The liquid ejecting unit 264 includes the plurality of ejectors 266, which are arranged in one direction (the Y direction), and a common liquid chamber SR (reservoir), which is shared by the plurality of ejectors 266. Each of the plurality of ejectors 266 of the present embodiment is formed for the corresponding one of the plurality of nozzles N. Inlet passages 754, which are in communication with the liquid container 14, are connected to the common liquid chamber SR. The common liquid chamber SR is a space that is long in the Y direction. The common liquid chamber SR serves as a reservoir for retaining ink supplied from the liquid container 14 through the inlet passages 754. In the illustrated example of FIG. 3, ink is supplied through two inlet passages 754. However, the number of the inlet passages 754 connected to the common liquid chamber SR may be one, or three or more. The common liquid chamber SR of the present embodiment is provided at the center area with respect to the plurality of ejectors 266 in such a way as to extend in the Y direction, which is the array direction of the plurality of ejectors 266. The common liquid chamber SR is in communication with each of the plurality of ejectors 266. Ink retained in the common liquid chamber SR is supplied to each of the plurality of ejectors 266 for ejection from the corresponding one of the plurality of nozzles N.

As illustrated in FIG. 4, the liquid ejecting unit 264 is a structural member that includes a pressure compartment substrate 72, a diaphragm 73, first piezoelectric elements 74A, and second piezoelectric elements 74B over one surface of a passage substrate 71 and further includes a communication plate 77 and a nozzle plate 76 under the other surface of the passage substrate 71. The passage substrate 71, the pressure compartment substrate 72, the communication plate 77, and the nozzle plate 76 are made of, for example, flat silicon plates. The passage substrate 71 of the present embodiment has a stacked structure that includes a first substrate 71*a* under the pressure compartment substrate 72 and a second substrate 71*b* over the communication plate 77. As described herein, the passage substrate 71 of the present embodiment includes the first substrate 71*a* and the second substrate 71*b* as two distinct substrates. However, the structure of the passage substrate 71 is not limited to this example. The first substrate 71*a* and the second substrate 71*b* may be formed integrally as a single substrate. The plurality of nozzles N is formed in the nozzle plate 76. Of the two surfaces of the nozzle plate 76, one facing toward the medium 12 is the ejecting surface 260 of the liquid ejecting head 26.

As illustrated in FIG. 4, each arbitrary one ejector 266 has a substantially plane-symmetric structure with respect to the virtual plane O-O. Accordingly, the structure of a first structure portion P1, which is located on the negative side in the X direction with respect to the virtual plane O-O, is substantially equivalent to the structure of a second structure portion P2, which is located on the positive side in the X direction with respect to the virtual plane O-O. The first structure portion P1 of the ejector 266 includes the first piezoelectric element 74A, the diaphragm 73, a first pressure compartment SA (cavity), a first passage EA, and a first branch passage DA. The second structure portion P2 of the ejector 266 includes the second piezoelectric element 74B, the diaphragm 73, a second pressure compartment SB (cavity), a second passage EB, and a second branch passage DB. The first piezoelectric element 74A is an example of a first drive element that changes the pressure of the first pressure compartment SA. The second piezoelectric element 74B is an example of a second drive element that changes the pressure of the second pressure compartment SB.

As illustrated in FIGS. 4 and 5, an opening 722*a* for configuring the first pressure compartment SA and an opening 722*b* for configuring the second pressure compartment SB are formed in the pressure compartment substrate 72 for each of the plurality of nozzles N. The opening 722*a* is formed in the first structure portion P1 of the pressure compartment substrate 72. The opening 722*b* is formed in the second structure portion P2 of the pressure compartment substrate 72. The diaphragm 73 is a thin member that is capable of vibrating elastically and is provided on the opposite surface of the pressure compartment substrate 72 whose one surface is on the passage substrate 71. In the example of the present embodiment, the diaphragm 73 in the first structure portion P1 and the diaphragm 73 in the second structure portion P2 are formed integrally. However, they may be formed separately. The diaphragm 73 is stacked on and bonded to the pressure compartment substrate 72 to constitute the ceiling part of the first pressure compartment SA and the ceiling part of the second pressure compartment SB.

In the example of the present embodiment, the pressure compartment substrate 72 and the diaphragm 73 are distinct from each other. However, the pressure compartment substrate 72 and the diaphragm 73 may be formed integrally. For example, it is possible to form the pressure compartment substrate 72 and the diaphragm 73 integrally by preparing a plate member that has a predetermined thickness and by selectively removing a part of the plate member in the thickness direction at areas corresponding to the openings 722*a* and 722*b*.

According to the above structure, the space between the diaphragm 73 and the passage substrate 71 inside the opening 722*a* functions as the first pressure compartment SA, and the space between the diaphragm 73 and the passage substrate 71 inside the opening 722*b* functions as the second pressure compartment SB.

An opening 712*a* for configuring the common liquid chamber SR is formed in the first substrate 71*a*. Of the two surfaces of the first substrate 71*a*, it is the second-substrate-side (71*b*) surface that has the opening 712*a*. The opening 712*a* formed in this +Z surface is closed by the second substrate 71*b*. An opening 712*b* formed in the −Z surface is in communication with the opening 712*a*.

The opening 712*b* formed in the pressure-compartment-substrate-side (72) surface of the first substrate 71*a* is in communication with an opening 724 of the pressure compartment substrate 72. Each of the openings 712*a*, 712*b*, and 724 is long in the Y direction. In a plan view, the width of the opening 712*b* in the X direction is narrower than the width of the opening 712*a* in the X direction, and the width of the opening 724 in the X direction is the same as the width of the opening 712*b* in the X direction. The meaning of "in a plan view" is: "as viewed in the Z direction". The same applies hereinafter.

At the −Z surface of the pressure compartment substrate 72, the opening 724 is closed by a flexible membrane 725. According to the above structure, the space between the flexible membrane 725 and the second substrate 71*b* inside the openings 712*a*, 712*b*, and 724 functions as the common liquid chamber SR. The flexible membrane 725 is a film (compliance substrate) that has flexibility for absorbing pressure fluctuations of ink inside the common liquid chamber SR.

The first pressure compartment SA and the second pressure compartment SB are in communication with each other via the common liquid chamber SR of the present embodiment. Specifically, for each of the plurality of ejectors 266, the first branch passage DA and the second branch passage DB are formed in the first substrate 71*a*. The first branch passage DA is an individual passage branching off from the common liquid chamber SR for connecting the common liquid chamber SR to the first pressure compartment SA of each of the plurality of ejectors 266. The second branch passage DB is an individual passage branching off from the common liquid chamber SR for connecting the common liquid chamber SR to the second pressure compartment SB of each of the plurality of ejectors 266. The first pressure compartment SA becomes filled with ink supplied from the common liquid chamber SR through the first branch passage DA. The second pressure compartment SB becomes filled with ink supplied from the common liquid chamber SR through the second branch passage DB.

Inside the area of the opening 712*a*, the first branch passage DA is located at an area that is closer to the first pressure compartment SA than the opening 712*b* is; more specifically, the first branch passage DA overlaps with the first pressure compartment SA in a plan view. Inside the area of the opening 712*a*, the second branch passage DB is located at an area that is closer to the second pressure compartment SB than the opening 712*b* is; more specifically, the second branch passage DB overlaps with the second pressure compartment SB in a plan view. Because of this layout, it is possible to configure such that each of the first branch passages DA extends toward the negative side in the Z direction from the opening 712*a* and is connected to the first pressure compartment SA and such that each of the second branch passages DB extends toward the negative side in the Z direction from the opening 712*a* and is connected to the second pressure compartment SB.

As illustrated in FIGS. 4 and 6, for each of the plurality of nozzles N, a communication passage 772 that is in communication with the nozzle N is formed in the communication plate 77. The first pressure compartment SA is in communication with the first passage EA, which is in communication with the communication passage 772. The second pressure compartment SB is in communication with the second passage EB, which is in communication with the communication passage 772. The communication passage 772 includes a passage 772C, which is in communication with the nozzle N, passages 772A and 772*a*, which are formed in the first structure portion P1, and passages 772B and 772*b*, which are formed in the second structure portion P2.

The passage 772C of the communication passage 772 is located at substantially the center of the liquid ejecting unit 264 in the X direction, and is located between the passage 772A and the passage 772B in a plan view. The passage 772A is in communication with the first passage EA and overlaps with the first pressure compartment SA in a plan view. The passage 772*a* is a narrowed passage that has a smaller sectional area than the passage 772A and connects the passage 772A to the passage 772C. The passage 772B is in communication with the second passage EB and overlaps with the second pressure compartment SB in a plan view. The passage 772*b* is a narrowed passage that has a smaller sectional area than the passage 772B and connects the passage 772B to the passage 772C. Since the passage 772*a* and the passage 772*b* are formed as narrowed passages, it is possible to increase the flow velocity of ink from the passage 772A and from the passage 772B toward the nozzle N. However, the sectional area of the passage 772*a* may be equal to the sectional area of the passage 772A, and the sectional area of the passage 772*b* may be equal to the sectional area of the passage 772B.

An opening 718*a* for configuring the first passage EA is formed in the passage substrate 71. In addition, an opening 718*b* for configuring the second passage EB is formed in the passage substrate 71. The opening 718*a* is located in the first structure portion P1. The opening 718*a* goes through the first substrate 71*a* and the second substrate 71*b* to connect the first pressure compartment SA to the communication passage 772. The opening 718*b* is located in the second structure portion P2. The opening 718*b* goes through the first substrate 71*a* and the second substrate 71*b* to connect the second pressure compartment SB to the communication passage 772.

The first passage EA is located on the negative side in the X direction with respect to the first pressure compartment SA. The first branch passage DA is located on the positive side in the X direction with respect to the first pressure compartment SA. The second passage EB is located on the positive side in the X direction with respect to the second pressure compartment SB. The second branch passage DB is located on the negative side in the X direction with respect to the second pressure compartment SB. The first passage EA and the first branch passage DA overlap with the first pressure compartment SA in a plan view. The second passage EB and the second branch passage DB overlap with the second pressure compartment SB in a plan view. This structure reduces the size of the liquid ejecting unit 264 in the X direction. Therefore, it is possible to reduce the size of the liquid ejecting head 26 in the X direction.

In the present embodiment, the first pressure compartment SA has a quadrangular shape (e.g., rectangle, square) in a plan view, and the passage 772A of the communication passage 772 also has a quadrangular shape in a plan view. However, the shape of the first pressure compartment SA and the passage 772A is not limited to the illustrated example. The shape in a plan view may be a parallelogram, an ellipse, a circle, or the like. In the present embodiment, the second pressure compartment SB has a quadrangular shape (e.g., rectangle, square) in a plan view, and the passage 772B of the communication passage 772 also has a quadrangular shape in a plan view. However, the shape of the second pressure compartment SB and the passage 772B is not limited to the illustrated example. The shape in a plan view may be a parallelogram, an ellipse, a circle, or the like.

In the present embodiment, the first branch passage DA and the first passage EA extend in the Z direction, and the second branch passage DB and the second passage EB extend in the Z direction. However, the passage may be inclined with respect to the Z direction. In the present embodiment, each of the first branch passage DA and the first passage EA overlaps with the first pressure compartment SA in a plan view. However, the passage may have a portion that does not overlap with the first pressure compartment SA in a plan view. In the present embodiment, each of the second branch passage DB and the second passage EB overlaps with the second pressure compartment SB in a plan view. However, the passage may have a portion that does not overlap with the second pressure compartment SB in a plan view.

In the structure described above, the first pressure compartment SA and the second pressure compartment SB are in communication with each other via the common liquid chamber SR, and the communication passage 772 of the nozzle N is connected to the first pressure compartment SA through the first passage EA and is connected to the second pressure compartment SB through the second passage EB. It is possible to change the pressure of the first pressure compartment SA by driving the first piezoelectric element 74A and change the pressure of the second pressure compartment SB by driving the second piezoelectric element 74B. Therefore, ink is supplied from the common liquid chamber SR to the first pressure compartment SA and the second pressure compartment SB, and, by driving the first piezoelectric element 74A and the second piezoelectric element 74B, it is possible to cause the ink to flow from the first pressure compartment SA and the second pressure compartment SB toward the communication passage 772. Because of this structure, the nozzle N is able to output ink flowing from both the first pressure compartment SA and the second pressure compartment SB, wherein the common liquid chamber SR functions as an ink supply passage. Therefore, compared with a structure in which the nozzle N is able to output ink flowing from one pressure compartment only, it is possible to increase the amount of ink ejected from the nozzle N.

The first pressure compartment SA is connected to the common liquid chamber SR through the first branch passage DA and is connected to the communication passage 772 through the first passage EA. The second pressure compartment SB is connected to the common liquid chamber SR through the second branch passage DB and is connected to the communication passage 772 through the second passage EB. Because of this structure, it is possible to produce a flow of ink that circulates in the order of, for example, the common liquid chamber SR→ the first branch passage DA→ the first pressure compartment SA→ the first passage EA→ the communication passage 772→ the second passage EB→ the second pressure compartment SB→ the common liquid chamber SR. In this way, the common liquid chamber SR functions as a part of an ink circulating passage, and it is possible to produce a flow of ink that circulates through a common passage between the first pressure compartment SA and the second pressure compartment SB and the communication passage 772 of the nozzle N. As explained above, in the present embodiment, a single common liquid chamber SR has a dual function, that is, a function of an ink supply passage and a function of an ink circulation passage. Therefore, compared with a structure in which separate common passages are provided for the first pressure compartment SA and the second pressure compartment SB, the circulating passage is shorter. The shorter circulation length reduces passage resistance. For this reason, circulation efficiency improves.

Moreover, in the present embodiment, a circulating flow of ink is produced for each of the plurality of ejectors 266 through the communication passage 772, which is near the meniscus of the nozzle N. Therefore, compared with a structure in which ink is circulated through a circulating common passage that is distant from the meniscus of the nozzle N, the effects of preventing ink from drying from the meniscus and preventing an increase in the viscosity of the ink, which results from drying, are very high. Moreover, in the present embodiment, it is possible to cause the common liquid chamber SR for supplying ink to function as a part of a circulating passage, meaning that it is unnecessary to provide a common passage for ink circulation separately from a common passage for ink supply. Therefore, a phenomenon that a part of ink of the first pressure compartment SA or the second pressure compartment SB is discharged into a common passage for ink circulation does not occur when an operation for ejecting ink from the nozzle N is performed. For this reason, compared with a structure in which a common passage for ink circulation is provided, it is possible to reduce a decrease in the amount of ink ejected from the nozzle N.

Figure 7:
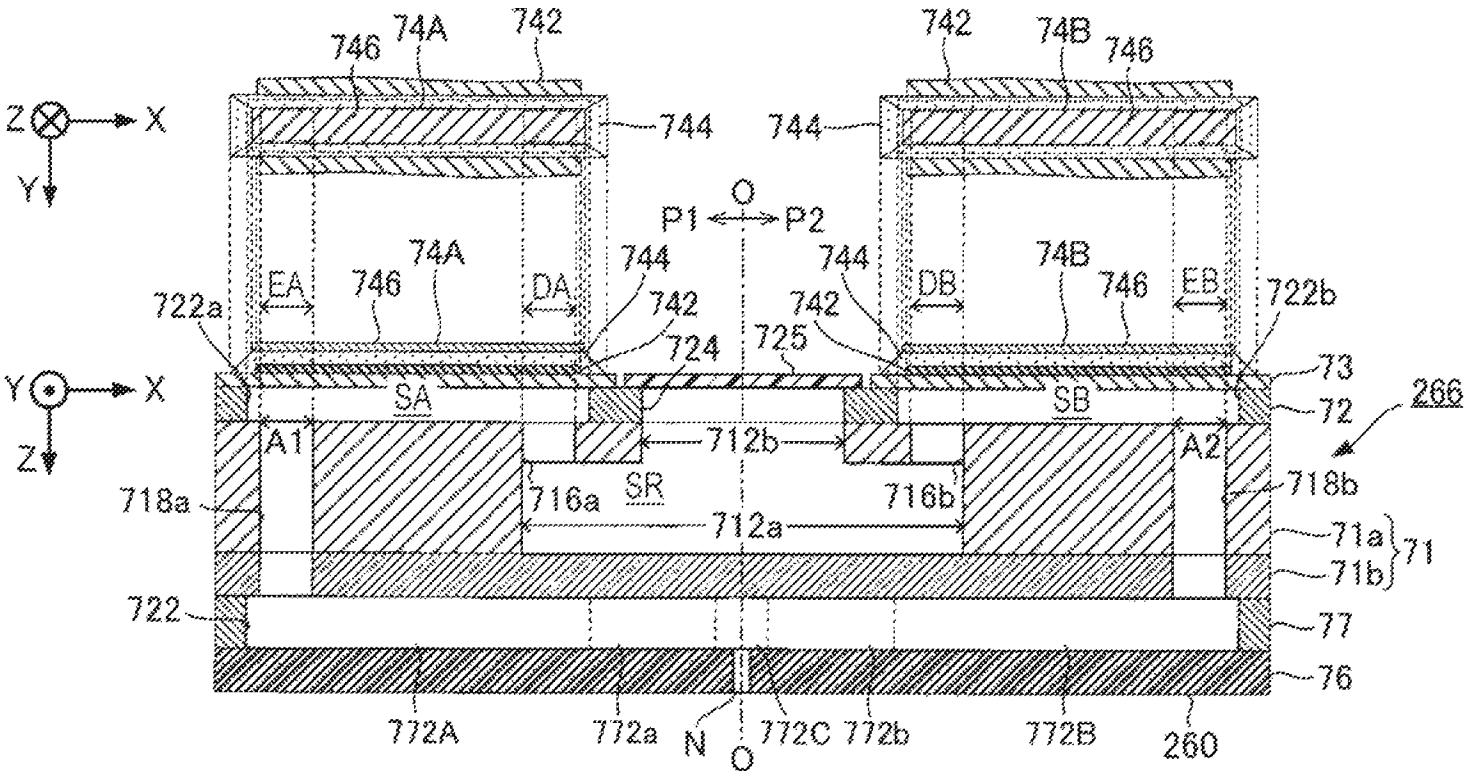
FIG. 7 is a plan view of a first piezoelectric element and a second piezoelectric element and a sectional view of an ejector.

An example of a specific structure of the first piezoelectric element 74A and the second piezoelectric element 74B will now be explained. An example of a specific structure of the first piezoelectric element 74A and the second piezoelectric element 74B in arbitrary one of the plurality of ejectors 266 is illustrated in FIG. 7. The upper part of FIG. 7 is a plan view of the first piezoelectric element 74A and the second piezoelectric element 74B as viewed in the Z direction. The lower part of FIG. 7 is a sectional view of the ejector 266 taken along the line IV-IV similarly to FIG. 4.

As illustrated in FIG. 7, the first piezoelectric element 74A and the second piezoelectric element 74B are deformable independently of each other and are arranged side by side in the X direction. The first piezoelectric element 74A is provided closer to the first passage EA in a plan view (on the negative side in the X direction, as viewed in the Z direction). The second piezoelectric element 74B is provided closer to the second passage EB in a plan view (on the positive side in the X direction, as viewed in the Z direction). In the present embodiment, the first piezoelectric element 74A overlaps with the first branch passage DA and the first passage EA in a plan view, and the second piezoelectric element 74B overlaps with the second branch passage DB and the second passage EB in a plan view.

As illustrated in a plan view of FIG. 7, each of the first piezoelectric element 74A and the second piezoelectric element 74B has a stack structure in which a piezoelectric layer 744 is sandwiched between a first electrode 742 and a second electrode 746 opposite each other. In the present embodiment, one piezoelectric element has two active areas each of which is deformable when a drive pulse is applied, and one of the two active areas functions as the first piezoelectric element 74A, and the other functions as the second piezoelectric element 74B. Specifically, the drive signal V is supplied to one of the first electrode 742 and the second electrode 746, and the reference potential VM having a predetermined reference level is supplied to the other. As a result of this supply, the two active areas where the first electrode 742, the piezoelectric layer 744, and the second electrode 746 overlap in a plan view (as viewed in the Z direction) deform to cause vibration. These two active areas behave as the first piezoelectric element 74A and the second piezoelectric element 74B respectively.

In lieu of the above structure, the first piezoelectric element 74A and the second piezoelectric element 74B may be separate elements that are independent of each other, wherein each of these two distinct elements has an individual first electrode 742 and an individual second electrode 746. However, in terms of higher degree of integration and simpler electric wiring, it is more advantageous to form a first drive element and a second drive element as the two active areas of one piezoelectric element than to separately arrange the first piezoelectric element 74A and the second piezoelectric element 74B as two distinct elements each having an individual first electrode 742 and an individual second electrode 746 independently.

The first electrode 742 of the present embodiment is formed as a common electrode on the surface of the diaphragm 73 continuously across all of the first piezoelectric elements 74A and the second piezoelectric elements 74B corresponding to the plurality of ejectors 266. The piezoelectric layer 744 is formed on the surface of the first electrode 742 (on the opposite surface that is not in contact with the diaphragm 73). Each of the second electrodes 746 is formed opposite to the diaphragm 73 with respect to the first electrode 742 in the layered structure. The piezoelectric layer 744 underlies each of the second electrodes 746 and is sandwiched between the first electrode 742 and each of the second electrodes 746. As described above, in the present embodiment, each of the second electrodes 746 is an individual electrode, and the second electrode 746 of the first piezoelectric element 74A and the second electrode 746 of the second piezoelectric element 74B are electrically independent of each other.

The second electrode 746 of the first piezoelectric element 74A is formed for each of the plurality of first pressure compartments SA. The second electrode 746 of the second piezoelectric element 74B is formed for each of the plurality of second pressure compartments SB. The first electrode 742 and the second electrodes 746 are electrically connected to the drive unit 262 via lead electrodes (not illustrated) respectively. According to this structure, the reference potential VM is supplied to the first electrode 742, which is a common electrode, and the drive signals V are supplied separately to the second electrode 746 of the first piezoelectric element 74A and the second electrode 746 of the second piezoelectric element 74B, which are individual electrodes. In the present embodiment, the first electrode 742 is a common electrode, and the second electrode 746 is an individual electrode. However, the structure is not limited to this example. The first electrode 742 may be an individual electrode, and the second electrode 746 may be a common electrode.

Figure 10:
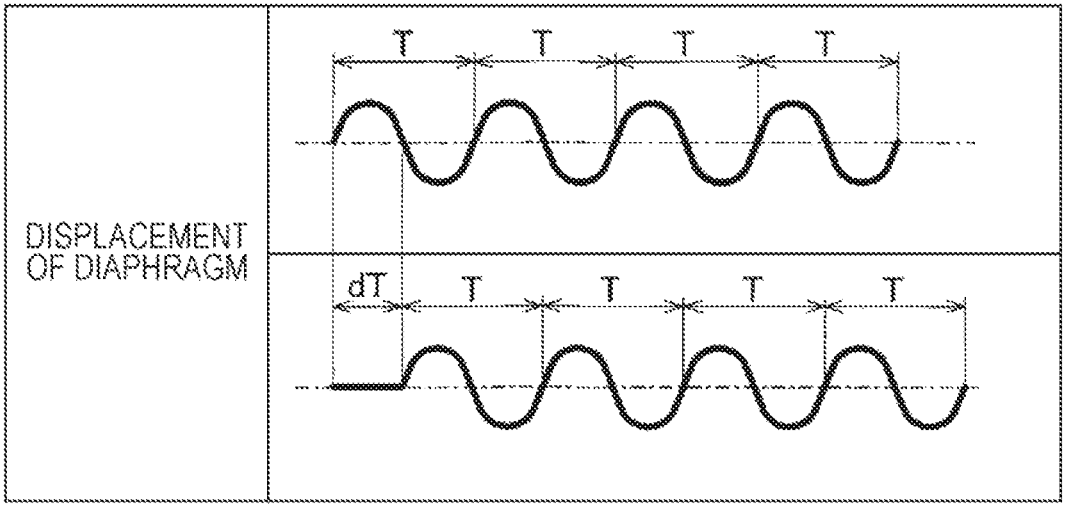
FIG. 10 is a diagram that illustrates the displacement of a diaphragm by circulating drive pulses.
Figure 11:
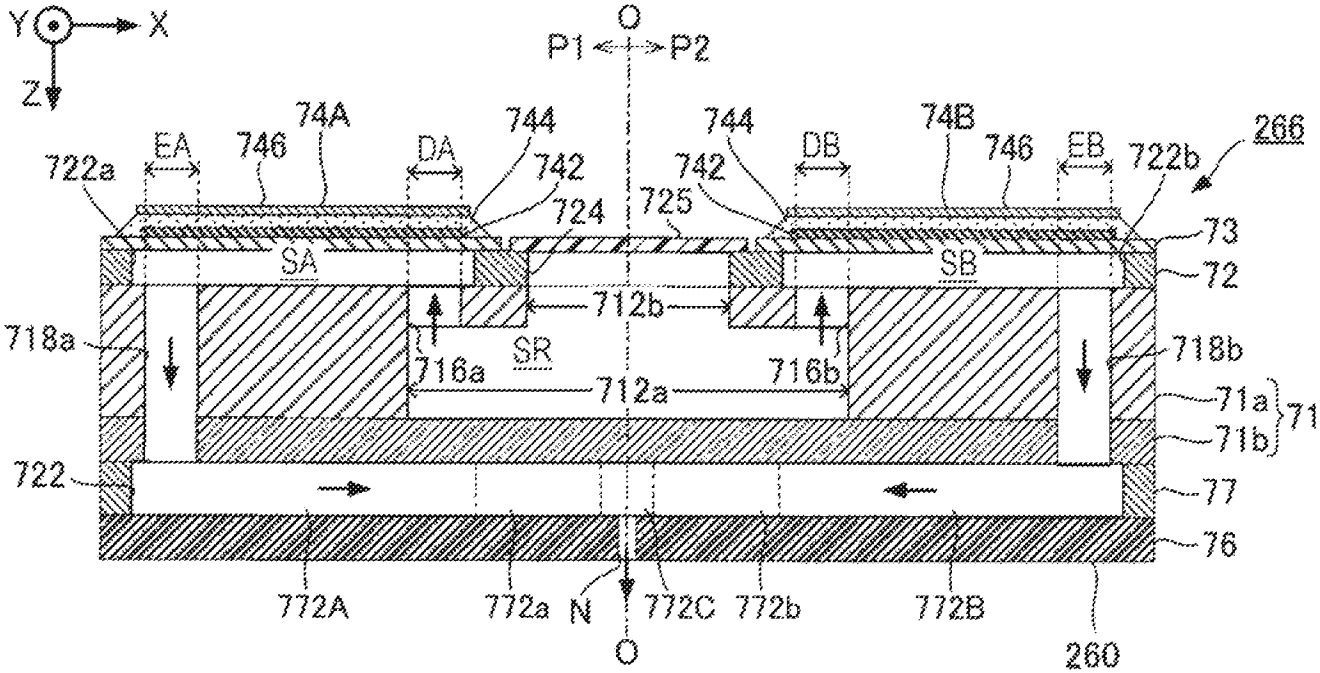
FIG. 11 is a diagram for explaining a flow operation caused in an ejector due to the application of ejecting drive pulses.
Figure 12:
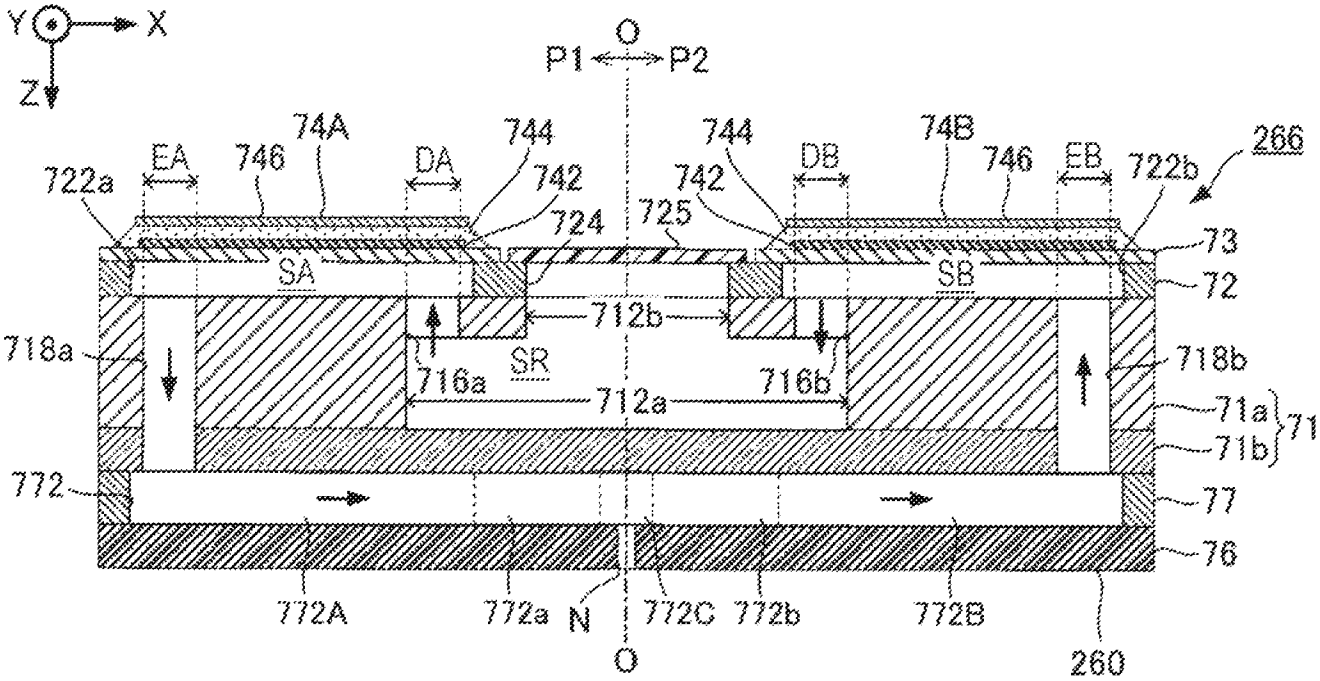
FIG. 12 is a diagram for explaining a flow operation caused in an ejector due to the application of circulating drive pulses.

FIG. 8, 9 is a diagram that illustrates a specific example of drive pulses for driving the first piezoelectric element 74A and the second piezoelectric element 74B of the present embodiment. Specifically, an example of ejecting drive pulses W1, which are pulses for ejecting ink from the nozzle N, is illustrated in FIG. 8, and an example of circulating drive pulses W2, which are pulses for circulating ink without ejection from the nozzle N, is illustrated in FIG. 9. FIG. 10 is a diagram that illustrates an example of the displacement of the diaphragm 73 by the circulating drive pulses W2. FIG. 11 is an operation explanation diagram for a flow produced in the ejector 266 when the first piezoelectric element 74A and the second piezoelectric element 74B are driven by the ejecting drive pulses W1 illustrated in FIG. 8. FIG. 12 is an operation explanation diagram for a flow produced in the ejector 266 when the first piezoelectric element 74A and the second piezoelectric element 74B are driven by the circulating drive pulses W2 illustrated in FIG. 9.

An example of an ejecting drive pulse W1*a*, which is applied to the first piezoelectric element 74A, is illustrated in the upper part of FIG. 8. An example of an ejecting drive pulse W1*b*, which is applied to the second piezoelectric element 74B, is illustrated in the lower part of FIG. 8. The ejecting drive pulse W1*a*, W1*b* is used when, for example, the following operation is performed: an operation of ejecting ink from the nozzle N for printing on the medium 12, and an operation of flushing that is ejection from the nozzle N for removing thickened ink, accretions, etc. for maintenance of the liquid ejecting head 26.

In the present embodiment, the ejecting drive pulse W1*b* has the same waveform and the same phase as those of the ejecting drive pulse W1*a*. However, the waveform of the ejecting drive pulse W1*b*, for example, amplitude and/or frequency, may be different from that of the ejecting drive pulse W1*a*. Since the phase of the drive pulse applied to the first piezoelectric element 74A and the phase of the drive pulse applied to the second piezoelectric element 74B are identical to each other, it is possible to simultaneously drive the first piezoelectric element 74A and the second piezoelectric element 74B in the same direction when ink is ejected. This makes it easier to produce a flow of ink from the first pressure compartment SA toward the communication passage 772 through the first passage EA and a flow of ink from the second pressure compartment SB toward the communication passage 772 through the second passage EB when ink is ejected. Therefore, it is possible to increase the amount of ink ejected from the nozzle N.

Next, a specific example of the operation of the ejector 266 by the ejecting drive pulse W1*a*, W1*b* will now be explained. Each of the ejecting drive pulses W1*a* and W1*b* illustrated in FIG. 8 has a high level VH and a low level VL in relation to the reference potential VM. Since the reference potential VM has a reference level, by setting the level of the low portion of the ejecting drive pulse W1*a*, W1*b* lower than the reference potential VM, it is possible to draw the meniscus in the nozzle N toward the communication passage 772. Conversely, by setting the level of the high portion of the ejecting drive pulse W1*a*, W1*b* higher than the reference potential VM, it is possible to force (push) the meniscus in the nozzle N toward the opening of the nozzle N (the opening of the nozzle N from which ink is to be ejected) opposite to the communication passage 772 and eject ink. The waveform of the ejecting drive pulse W1*a*, W1*b* is not limited to the example illustrated in FIG. 8. For example, the waveform of the ejecting drive pulse W1*a*, W1*b* may be modified as follows: the level of the ejecting drive pulse W1*a*, W1*b* is higher than the reference potential VM when the meniscus in the nozzle N is drawn toward the communication passage 772 and is lower than the reference potential VM when the meniscus in the nozzle N is forced toward the opening of the nozzle N.

The first piezoelectric element 74A deforms to cause the vibration of the diaphragm 73 due to supply of the drive signal V by the ejecting drive pulse W1*a*. Therefore, the pressure of the first pressure compartment SA changes. The second piezoelectric element 74B deforms to cause the vibration of the diaphragm 73 due to supply of the drive signal V by the ejecting drive pulse W1*b*. Therefore, the pressure of the second pressure compartment SB changes. Because of this change in pressure, as indicated by arrows in FIG. 11, ink flows from the first pressure compartment SA toward the communication passage 772 through the first passage EA, and ink flows from the second pressure compartment SB toward the communication passage 772 through the second passage EB. Therefore, ink of the first pressure compartment SA and ink of the second pressure compartment SB are ejected from the nozzle N.

When the ejecting drive pulses W1*a* and W1*b* are applied, ink is ejected from the nozzle N; therefore, a flow toward the nozzle N is easier to be produced in each of the first passage EA and the second passage EB than a circulation flow back to the first pressure compartment SA or the second pressure compartment SB. Moreover, since the ejecting drive pulse W1*b* has the same phase as that of the ejecting drive pulse W1*a*, both a flow toward the nozzle N from the first passage EA and a flow toward the nozzle N from the second passage EB are produced easily in the communication passage 772. Therefore, compared with a structure that includes only one of the first passage EA and the second passage EB, it is possible to increase the amount of ink ejection.

The ejecting drive pulse W1*a*, W1*b* is not limited to the example illustrated in FIG. 8. For example, it is possible to change the amount of ink ejected from the nozzle N by changing at least one of the following parameters of the ejecting drive pulse W1*a*, W1*b*: the slope of the waveform, the highest level value, the lowest level value, the amplitude of the waveform, the frequency of the waveform. For example, it is possible to increase the amount of ink ejection by increasing the amplitude of the waveform. It is possible to change the dot size of an ink droplet that lands onto the surface of the medium 12 by changing the number of the ejecting drive pulses W1*a*, W1*b* included in one cycle time T or the waveform shape thereof.

An example of a circulating drive pulse W2*a*, which is applied to the first piezoelectric element 74A, is illustrated in the upper part of FIG. 9. An example of a circulating drive pulse W2*b*, which is applied to the second piezoelectric element 74B, is illustrated in the lower part of FIG. 9. The circulating drive pulse W2*a*, W2*b* is used for circulating ink in the ejector 266 without ejection from the nozzle N. For example, when ink is ejected for each one pass while moving the liquid ejecting head 26 in the X direction, the circulating drive pulse W2 is applied between one pass and another pass to cause vibration in the first pressure compartment SA and the second pressure compartment SB for ink circulation. Ink may be circulated between one print job and another print job. Ink may be circulated at the time of maintenance.

A meniscus formed in the nozzle N is an interface between ink and air. Therefore, at the meniscus, the process of vaporization of a solvent such as moisture progresses due to drying, and a balance between a solute and a solvent contained in ink gets lost; therefore, an increase in ink viscosity, solute precipitation, etc. tends to progress. If an increase in ink viscosity, solute precipitation, etc. progresses, it becomes harder to eject ink from the nozzle N. This might cause poor ejection or, even worse, the clogging of the nozzle N. In the present embodiment, it is possible to circulate ink through the communication passage 772 near the nozzle N. Therefore, it is possible to effectively prevent ink from drying and increasing in viscosity at the meniscus of the nozzle N. Moreover, compared with ejecting viscous ink from the nozzle N by performing the aforementioned flushing operation, it is possible to reduce wasteful ink consumption.

In the present embodiment, the circulating drive pulse W2*b* has the same waveform as that of the circulating drive pulse W2*a* but is different in phase from the circulating drive pulse W2*a*. However, the circulating drive pulse W2*b*, for example, amplitude and/or frequency, may be different from that of the circulating drive pulse W2*a*. Since the phase of the drive pulse applied to the first piezoelectric element 74A and the phase of the drive pulse applied to the second piezoelectric element 74B are different from each other, it is possible to produce a phase difference between vibration transmitted to the first passage EA by driving the first piezoelectric element 74A and vibration transmitted to the second passage EB by driving the second piezoelectric element 74B. Therefore, it is possible to make the manner of transmission of vibration (i.e., how vibration is transmitted) to the first passage EA from the first pressure compartment SA and the manner of transmission of vibration to the second passage EB from the second pressure compartment SB different from each other. Moreover, when ink circulation is performed, ink in the first pressure compartment SA and ink in the second pressure compartment SB tend to flow toward, of the first passage EA and the second passage EB, one to which vibration transmission is easier.

Therefore, by making the manner of transmission of vibration to the first passage EA and the manner of transmission of vibration to the second passage EB different from each other, it becomes easier to produce a flow of ink that circulates in one specific direction through the communication passage 772, the first pressure compartment SA, and the second pressure compartment SB. Specifically, in ink circulation, when one of the first passage EA and the second passage EB becomes a going passage, such different manner of transmission of vibration makes it easier for the other to become a returning passage. Therefore, a flow of ink that circulates through the communication passage 772 of the nozzle N, and the first pressure compartment SA and the second pressure compartment SB via the common liquid chamber SR, is produced easily.

Next, a specific example of the operation of the ejector 266 by the circulating drive pulse W2*a*, W2*b* will now be explained. Each of the circulating drive pulses W2*a* and W2*b* illustrated in FIG. 9 has a high level VH and a low level VL in relation to the reference potential VM. Each of the circulating drive pulses W2*a* and W2*b* has a waveform that is smaller in amplitude than the waveform of each of the ejecting drive pulses W1*a* and W1*b*. Because of this waveform, it is possible to cause minute vibration for the first pressure compartment SA and the second pressure compartment SB by applying a plurality of the circulating drive pulses W2 with repetition of the cycle T. This makes it easier to produce a flow of ink that circulates without ejection from the nozzle N. Although FIG. 9 depicts that the waveform of the circulating drive pulse W2*b* is the same as that of the circulating drive pulse W2*a*, it is not limited to the illustrated example. The amplitude and/or frequency, etc. of the circulating drive pulse W2*b* may be different from that of the circulating drive pulse W2*a*.

If the waveform of one cycle time T is defined as one pulse wave, FIG. 9 depicts a case where a phase difference dT between the circulating drive pulses W2*a* and W2*b* is equal to ½ pulse wave, which corresponds to one half of the cycle time T. According to this waveform configuration, the phase of the circulating drive pulse W2*b* is the opposite of the phase of the circulating drive pulse W2*a*. Therefore, the circulating drive pulse W2*b* is in the low level VL when the circulating drive pulse W2*a* is in the high level VH. The circulating drive pulse W2*b* is in the high level VH when the circulating drive pulse W2*a* is in the low level VL. Accordingly, the first piezoelectric element 74A and the second piezoelectric element 74B vibrate in directions that are the opposite of each other. Therefore, one of the first passage EA and the second passage EB becomes a going passage, and the other becomes a returning passage. For this reason, a flow of ink that circulates through the communication passage 772 of the nozzle N and the first pressure compartment SA and the second pressure compartment SB via the common liquid chamber SR in one direction is produced easily.

Specifically, the application of the circulating drive pulse W2*a* to the first piezoelectric element 74A and the circulating drive pulse W2*b* to the second piezoelectric element 74B causes deformation and minute vibration of the first piezoelectric element 74A and the second piezoelectric element 74B separately from each other. Therefore, the area in the diaphragm 73 that overlaps with the first piezoelectric element 74A in a plan view vibrates as illustrated in the upper part of FIG. 10, and the area in the diaphragm 73 that overlaps with the second piezoelectric element 74B in a plan view vibrates with a phase shift as illustrated in the lower part of FIG. 10. This makes it possible for the area in the first pressure compartment SA that overlaps with the first piezoelectric element 74A in a plan view and the area in the second pressure compartment SB that overlaps with the second piezoelectric element 74B in a plan view to vibrate in phases that are the opposite of each other.

Therefore, in the present embodiment, vibration is transmitted from the second pressure compartment SB to the second passage EB, which is located on the side where the second piezoelectric element 74B is provided, in the opposite phase in relation to the phase of transmission of vibration from the first pressure compartment SA to the first passage EA, which is located on the side where the first piezoelectric element 74A is provided. Therefore, as indicated by arrows in FIG. 12, a flow of ink that goes from the first pressure compartment SA through the first passage EA to the communication passage 772, and next goes through the second passage EB to the second pressure compartment SB without ejection from the nozzle N, and then returns from the second pressure compartment SB to the first pressure compartment SA via the common liquid chamber SR (a counter-clockwise flow circulating around the Y axis) is produced. Specifically, it is possible to produce a flow of ink that circulates in the order of: the common liquid chamber SR→ the first branch passage DA→ the first pressure compartment SA→ the first passage EA→ the communication passage 772→ the second passage EB→ the second pressure compartment SB→ the common liquid chamber SR. Since a flow of ink that circulates through the communication passage 772 of the nozzle N, the first pressure compartment SA, and the second pressure compartment SB is produced, it is possible to prevent ink from drying and increasing in viscosity.

The circulating drive pulse W2*a*, W2*b* is not limited to the example illustrated in FIG. 9. For example, although the reference potential VM in the example illustrated in FIG. 9 has a mid level between the high level VH and the low level VL, the low level VL of FIG. 9 may be taken as the reference potential VM. It is possible to change the flow velocity of ink that circulates or change the frequency of vibration of ink by changing the slope of the waveform of the circulating drive pulse W2*a*, W2*b*, the highest level value, the lowest level value, the amplitude of the waveform, the frequency of the waveform, or by changing the number of the circulating drive pulses W2*a*, W2*b* included in one cycle time T or the waveform shape. The number of the circulating drive pulses W2*a*, W2*b* or the waveform shape may be changed depending on the type of ink. For example, the viscosity of ink that has high aggregation such as pigment ink is more likely to increase in the neighborhood of the meniscus of the nozzle N than ink that has low aggregation such as dye ink. Therefore, the number of the circulating drive pulses W2*a*, W2*b* or the waveform shape may be changed such that higher circulation efficiency is set for ink that has high aggregation than ink that has low aggregation.

In the present embodiment, equality holds for the sectional area of the first passage EA and the sectional area of the second passage EB throughout the entirety from the pressure compartment side toward the communication passage 772. That is, as illustrated in FIG. 7, the sectional area A1 of the first passage EA is equal to the sectional area A2 of the second passage EB. The sectional area mentioned here means the area size of a cross section orthogonal to the direction in which the first passage EA and the second passage EB extend, and therefore means the area size of a cross section of each of the first passage EA and the second passage EB taken in parallel with the X-Y plane. In the example illustrated in FIG. 7, the sectional area A1 of the first passage EA does not change from its pressure-compartment-side end, which is connected to the first pressure compartment SA, to its communication-passage-side end, which is connected to the communication passage 772. The sectional area A2 of the second passage EB also does not change from its pressure-compartment-side end, which is connected to the second pressure compartment SB, to its communication-passage-side end, which is connected to the communication passage 772.

Since the sectional area of the first passage EA is equal to the sectional area of the second passage EB, the passage resistance of the first passage EA is also substantially equal to the passage resistance of the second passage EB. For this reason, when the flow indicated by arrows in FIG. 11 is produced due to the driving of the first piezoelectric element 74A and the second piezoelectric element 74B at the same phase for ejecting ink, the same amount of ink flows from the first passage EA and the second passage EB into the communication passage 772 easily. Therefore, the amount of ink ejected from the nozzle N is approximately twice as large as the amount of ink that would be ejected if ink flowing from only one of the first pressure compartment SA and the second pressure compartment SB were ejected.

Incidentally, when the sectional area of the first passage EA is equal to the sectional area of the second passage EB, a reverse flow in the opposite direction (a clockwise flow circulating around the Y axis) against the direction indicated by arrows in FIG. 12 could be produced. In other words, a flow of ink that goes from the second pressure compartment SB through the second passage EB to the communication passage 772, and next goes through the first passage EA to the first pressure compartment SA, and then returns from the first pressure compartment SA to the second pressure compartment SB via the common liquid chamber SR could be produced. Specifically, it is possible to produce a flow of ink that circulates in the order of: the common liquid chamber SR→ the second branch passage DB→ the second pressure compartment SB→ the second passage EB→ the communication passage 772→ the first passage EA→ the first pressure compartment SA→ the common liquid chamber SR. Even with such a reverse ink circulation flow, it is possible to prevent an increase in ink viscosity.

However, compared with a structure in which a flow of ink circulating in the opposite direction could be produced with substantially the same likelihood as that of a flow of ink circulating in the direction indicated by arrows in FIG. 12, as in the case where the sectional area of the first passage EA is equal to the sectional area of the second passage EB, it is easier to produce a circulating flow of ink in a short time efficiently if the likelihood of production of a flow of ink circulating in one specific direction is heightened.

In this respect, in the present embodiment, it is possible to make the manner of transmission of vibration to the first passage EA and the manner of transmission of vibration to the second passage EB different from each other because it is possible to drive the first piezoelectric element 74A over the first passage EA and the second piezoelectric element 74B over the second passage EB independently of each other. This makes it easier to produce a flow of ink that circulates in one specific direction through the communication passage 772, the first pressure compartment SA, and the second pressure compartment SB. Therefore, a flow of ink that circulates through the communication passage 772 of the nozzle N, the first pressure compartment SA, and the second pressure compartment SB is produced in a short time efficiently. Consequently, ink circulation efficiency is high.

For example, in FIG. 9, since the circulating drive pulse W2*a* is set at the high level VH first, the first piezoelectric element 74A is driven to cause the displacement of the diaphragm 73 in the direction of forcing ink out of the first pressure compartment SA toward the first passage EA. The circulating drive pulse W2*b* has not been applied to the second piezoelectric element 74B yet during this operation. Therefore, as indicated by arrows in FIG. 12, a flow of ink that goes from the first pressure compartment SA through the first passage EA to the communication passage 772 and next goes through the second passage EB to the second pressure compartment SB (a counter-clockwise flow circulating around the Y axis) is produced easily. After that, the first piezoelectric element 74A and the second piezoelectric element 74B are driven alternately in directions opposite to each other, thereby causing alternate vibrations in the direction of forcing ink out toward the first passage EA and the direction of sucking ink in from the second passage EB. Therefore, a flow of ink that circulates as illustrated in FIG. 12 accelerates. This improves ink circulation efficiency dramatically.

In FIG. 9, the phases of the circulating drive pulses W2*a* and W2*b* are shifted from each other such that the first piezoelectric element 74A is driven before the second piezoelectric element 74B. However, the phase relation is not limited to the illustrated example. The phases of the circulating drive pulses W2*a* and W2*b* may be shifted from each other such that the second piezoelectric element 74B is driven before the first piezoelectric element 74A. In this modification example, since the circulating drive pulse W2*b* is set at the high level VH first, the second piezoelectric element 74B is driven to cause the displacement of the diaphragm 73 in the direction of forcing ink out of the second pressure compartment SB toward the second passage EB. The circulating drive pulse W2*a* has not been applied to the first piezoelectric element 74A yet during this operation. Therefore, in the opposite direction against the direction indicated by arrows in FIG. 12, a flow of ink that goes from the second pressure compartment SB through the second passage EB to the communication passage 772 and next goes through the first passage EA to the first pressure compartment SA (a clockwise flow circulating around the Y axis) is produced easily.

As explained above, even though the sectional area of the first passage EA is equal to the sectional area of the second passage EB, the present embodiment makes it easier to produce a flow of ink that circulates in one specific direction. Therefore, it is possible to produce a circulating flow of ink in a short time efficiently, thereby achieving high ink circulation efficiency. In the present embodiment, the phase difference dT between the circulating drive pulses W2*a* and W2*b* is equal to ½ pulse wave corresponding to one half of the cycle time T. However, the length of the phase difference dT is not limited to the illustrated example. For example, the phase difference dT may be equal to one pulse wave corresponding to one cycle time T, or may be equal to a plurality of pulse waves. Increasing the phase difference dT between the circulating drive pulses W2*a* and W2*b* makes it easier to produce a flow of ink that circulates in one direction.

The scope of the present disclosure is not limited to a structure in which the sectional area of the first passage EA is equal to the sectional area of the second passage EB. The first passage EA and the second passage EB may have portions whose sectional areas are different from each other. For example, in FIG. 7, the sectional area A1 of the pressure-compartment-side end of the first passage EA may be larger than the sectional area A2 of the pressure-compartment-side end of the second passage EB. If the sectional area of the pressure-compartment-side end of the first passage EA and the sectional area of the pressure-compartment-side end of the second passage EB are different from each other, when ink is circulated by applying the circulating drive pulses W2*a* and W2*b* that are different in phase from each other, it becomes easier for ink to flow out of the first pressure compartment SA into the first passage EA that has a larger sectional area, and it becomes easier for ink to flow into the second pressure compartment SB from the second passage EB that has a smaller sectional area. Therefore, the first passage EA becomes a going passage, and the second passage EB becomes a returning passage, and a flow of ink that circulates through the communication passage 772 of the nozzle N, the first pressure compartment SA, and the second pressure compartment SB in one direction is produced easily.

In another example, the sectional area A2 of the pressure-compartment-side end of the second passage EB may be larger than the sectional area A1 of the pressure-compartment-side end of the first passage EA. According to this modified structure, when ink is circulated, it becomes easier for ink to flow out of the second pressure compartment SB into the second passage EB that has a larger sectional area, and it becomes easier for ink to flow into the first pressure compartment SA from the first passage EA that has a smaller sectional area. Therefore, the second passage EB becomes a going passage, and the first passage EA becomes a returning passage, and a flow of ink that circulates through the communication passage 772 of the nozzle N, the first pressure compartment SA, and the second pressure compartment SB in one direction is produced easily.

The first pressure compartment SA and the second pressure compartment SB of the present embodiment are arranged side by side in the X direction. In addition, the common liquid chamber SR is arranged between the first pressure compartment SA and the second pressure compartment SB in a plan view. Compared with a structure in which two common liquid chambers SR that are separately in communication with the first pressure compartment SA and the second pressure compartment SB respectively are arranged adjacently in the X direction in addition to the first pressure compartment SA and the second pressure compartment SB in a plan view, the structure of the present embodiment is smaller in the X direction. In the present embodiment, as illustrated in FIG. 3, the nozzles N are arranged in line along the virtual plane O-O, wherein each of the nozzles N is arranged between the first pressure compartment SA and the second pressure compartment SB. However, the layout of the nozzles N is not limited to the illustrated example. Each of the nozzles N may be arranged anywhere in communication with the communication passage 772.

Second Embodiment

Next, a second embodiment of the present disclosure will now be explained. In each exemplary embodiment described below, the same reference numerals as those used in the description of the first embodiment are assigned to elements that are the same in operation and/or function as those in the first embodiment, and a detailed explanation of them is omitted. The second embodiment discloses an example in which the layout of the first pressure compartment SA and the second pressure compartment SB is modified from that of the first embodiment.

Figure 13:
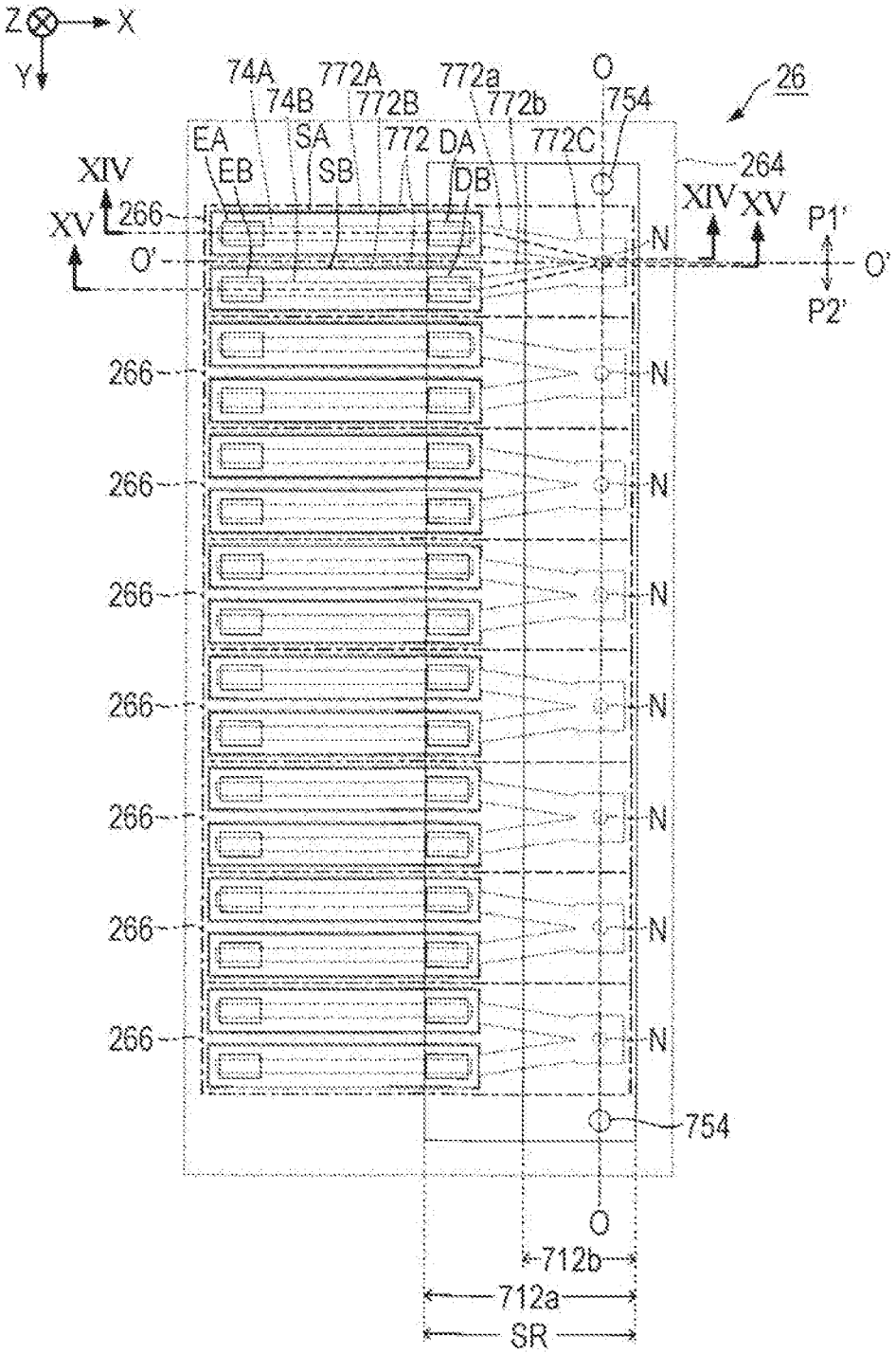
FIG. 13 is a schematic view of the passage structure of a liquid ejecting unit according to a second embodiment.
Figure 14:
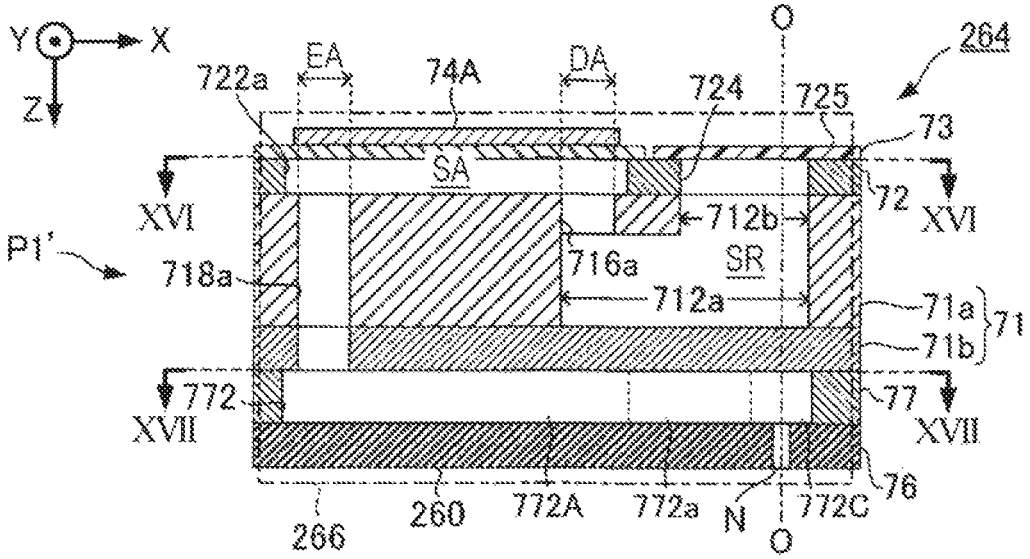
FIG. 14 is a sectional view of the liquid ejecting unit taken along the line XIV-XIV of FIG. 13.
Figure 15:
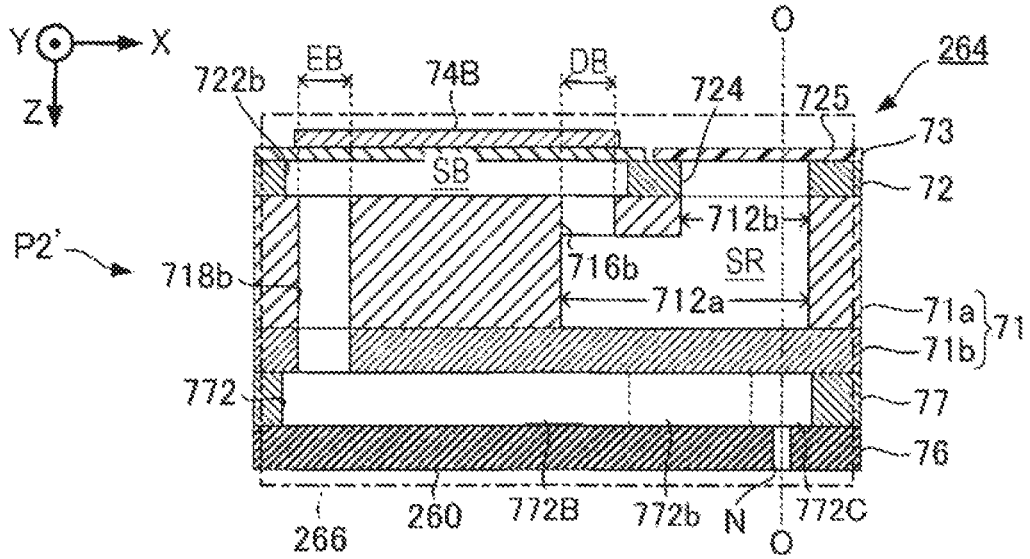
FIG. 15 is a sectional view of the liquid ejecting unit taken along the line XV-XV of FIG. 13.
Figure 16:
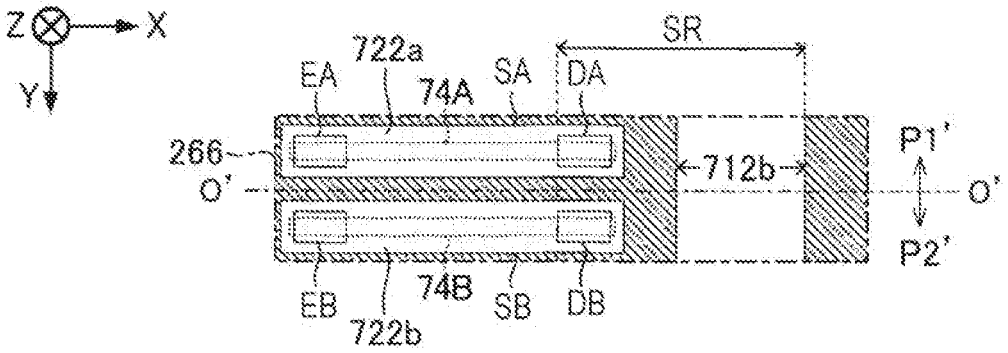
FIG. 16 is a sectional view of an ejector taken along the line XVI-XVI of FIG. 14.
Figure 17:
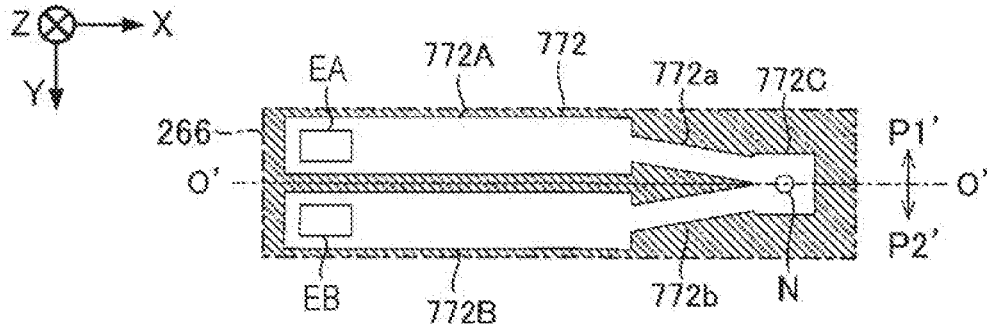
FIG. 17 is a sectional view of the ejector taken along the line XVII-XVII of FIG. 14.

FIG. 13 is a schematic view of the passage structure of the liquid ejecting unit 264, wherein the liquid ejecting head 26 according to the second embodiment is viewed from the negative side in the Z direction. Each of FIGS. 14 and 15 is a diagram that illustrates the structure of the liquid ejecting unit 264 with a focus on arbitrary one of the plurality of ejectors 266. Specifically, FIG. 14 is a sectional view of the liquid ejecting unit 264 taken along the line XIV-XIV of FIG. 13, and FIG. 15 is a sectional view of the liquid ejecting unit 264 taken along the line XV-XV of FIG. 13. FIG. 16 is a sectional view of the ejector 266 taken along the line XVI-XVI of FIG. 14. FIG. 17 is a sectional view of the ejector 266 taken along the line XVII-XVII of FIG. 14.

As illustrated in FIG. 13, in the second embodiment, the first pressure compartment SA and the second pressure compartment SB are arranged next to each other in the Y direction. In addition, in a plan view, the first pressure compartment SA and the second pressure compartment SB are arranged on one side in the X direction (in FIG. 13, on the negative side in the X direction) with respect to the common liquid chamber SR. In the liquid ejecting unit 264 illustrated in FIG. 13, in a plan view, the nozzles N are arranged in line along the virtual plane O-O on the positive side in the X direction with respect to the first pressure compartment SA and the second pressure compartment SB. Each arbitrary one ejector 266 illustrated in FIG. 13 has a substantially plane-symmetric structure with respect to a virtual plane O'-O' that is parallel to the X-Z plane. The structure on the negative side in the Y direction with respect to the virtual plane O'-O' is defined as a first structure portion P1'. The structure on the positive side in the Y direction with respect to the virtual plane O'-O' is defined as a second structure portion P2'.

As illustrated in the sectional view of FIG. 14, the first structure portion P1' of the ejector 266 has substantially the same structure as that of the first structure portion P1 illustrated in FIG. 4. Specifically, the first structure portion P1' includes the first piezoelectric element 74A, the diaphragm 73, the first pressure compartment SA, the first passage EA, and the first branch passage DA. As illustrated in the sectional view of FIG. 15, the second structure portion P2' of the ejector 266 has substantially the same structure as that of the second structure portion P2 illustrated in FIG. 4, except that the negative side and the positive side in the X direction are reversed. Specifically, the second structure portion P2' includes the second piezoelectric element 74B, the diaphragm 73, the second pressure compartment SB, the second passage EB, and the second branch passage DB.

As illustrated in FIG. 16, in the pressure compartment substrate 72 according to the second embodiment, the opening 722*a* for configuring the first pressure compartment SA and the opening 722*b* for configuring the second pressure compartment SB are formed next to each other in the Y direction. The opening 722*a* and the opening 722*b* illustrated in FIG. 16 are located on the negative side in the X direction with respect to the opening 712*b* for configuring the common liquid chamber SR. As illustrated in FIG. 17, which shows the communication passage 772 according to the second embodiment, the passage 772A of the first structure portion P1' and the passage 772B of the second structure portion P2' are located on the negative side in the X direction with respect to the passage 772C, which is in communication with the nozzle N.

According to the structure of the second embodiment described above, the first pressure compartment SA and the second pressure compartment SB are arranged on the negative side in the X direction with respect to the common liquid chamber SR in a plan view. Therefore, it is possible to reduce the size in the X direction, compared with a structure in which the first pressure compartment SA is arranged on one side in the X direction with respect to the common liquid chamber SR, the second pressure compartment SB is arranged on the other side, and the common liquid chamber SR is arranged therebetween in a plan view.

In the structure of the second embodiment, similarly to the foregoing embodiment, for example, ejecting drive pulses having the same phase as illustrated in FIG. 8 are applied to the first piezoelectric element 74A and the second piezoelectric element 74B respectively when ink is ejected. By this means, it is possible to eject ink of the first pressure compartment SA and ink of the second pressure compartment SB from the nozzle N. Therefore, compared with a structure in which ink flowing from only one of the first pressure compartment SA and the second pressure compartment SB is ejected, it is possible to increase the amount of ink ejected from the nozzle N. Circulating drive pulses having phases different from each other as illustrated in FIG. 9, for example, are applied to the first piezoelectric element 74A and the second piezoelectric element 74B respectively when ink is circulated. By this means, it is possible to produce a flow of ink that circulates through the communication passage 772 of the nozzle N, the first pressure compartment SA, and the second pressure compartment SB without ejection from the nozzle N. Similarly to the foregoing embodiment, a single common liquid chamber SR has a dual function, that is, a function of an ink supply passage and a function of an ink circulation passage. Therefore, compared with a structure in which separate common passages are provided for the first pressure compartment SA and the second pressure compartment SB, the circulating passage is shorter. The shorter circulation length reduces passage resistance. For this reason, circulation efficiency improves.

Third Embodiment

Next, a third embodiment of the present disclosure will now be explained. The third embodiment discloses an example in which each one ejector 266 includes a plurality of the first pressure compartments SA and a plurality of the second pressure compartments SB. With this structure, it is possible to increase the amount of ink ejected from the nozzle N.

Figure 18:
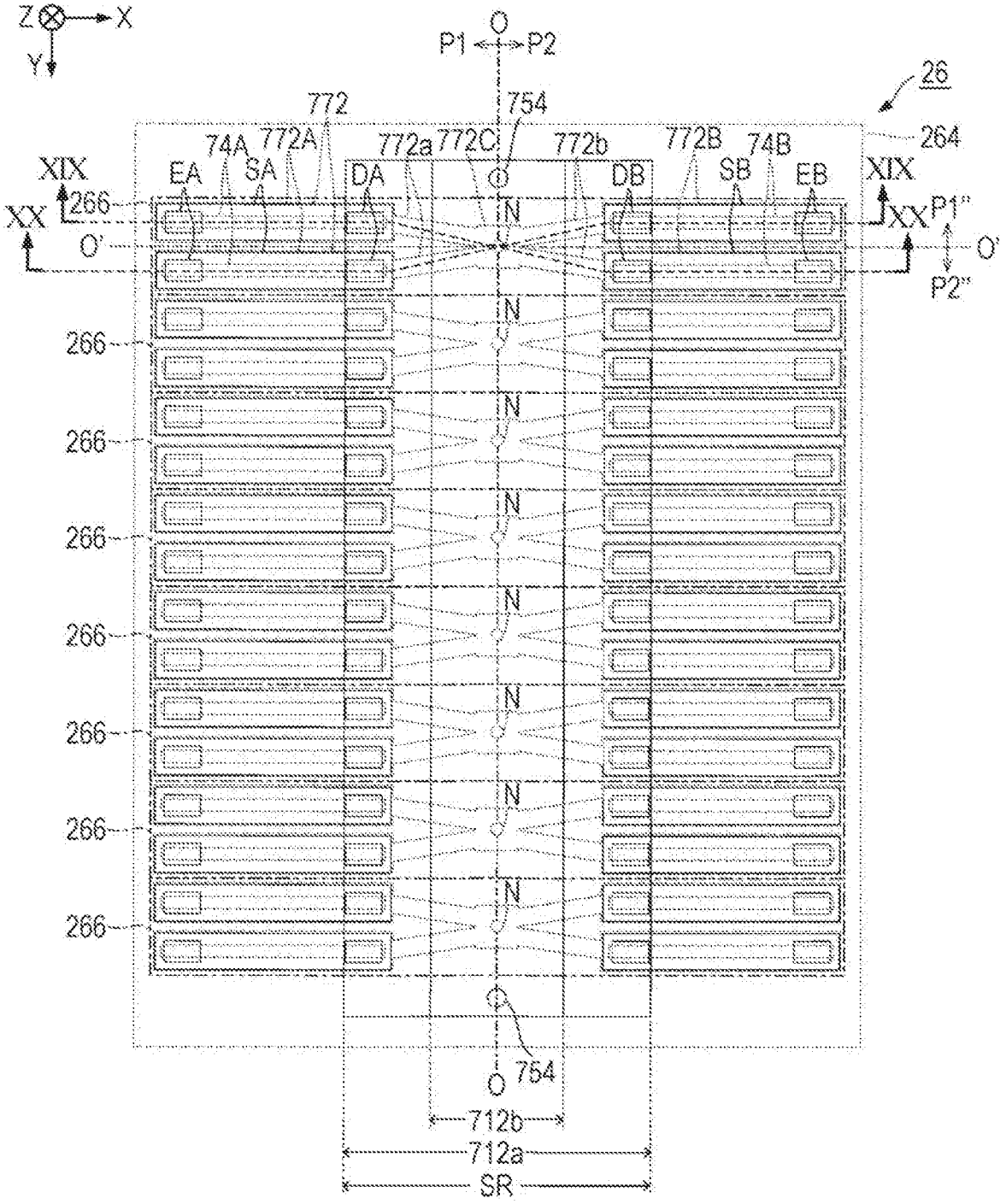
FIG. 18 is a schematic view of the passage structure of a liquid ejecting unit according to a third embodiment.
Figure 19:
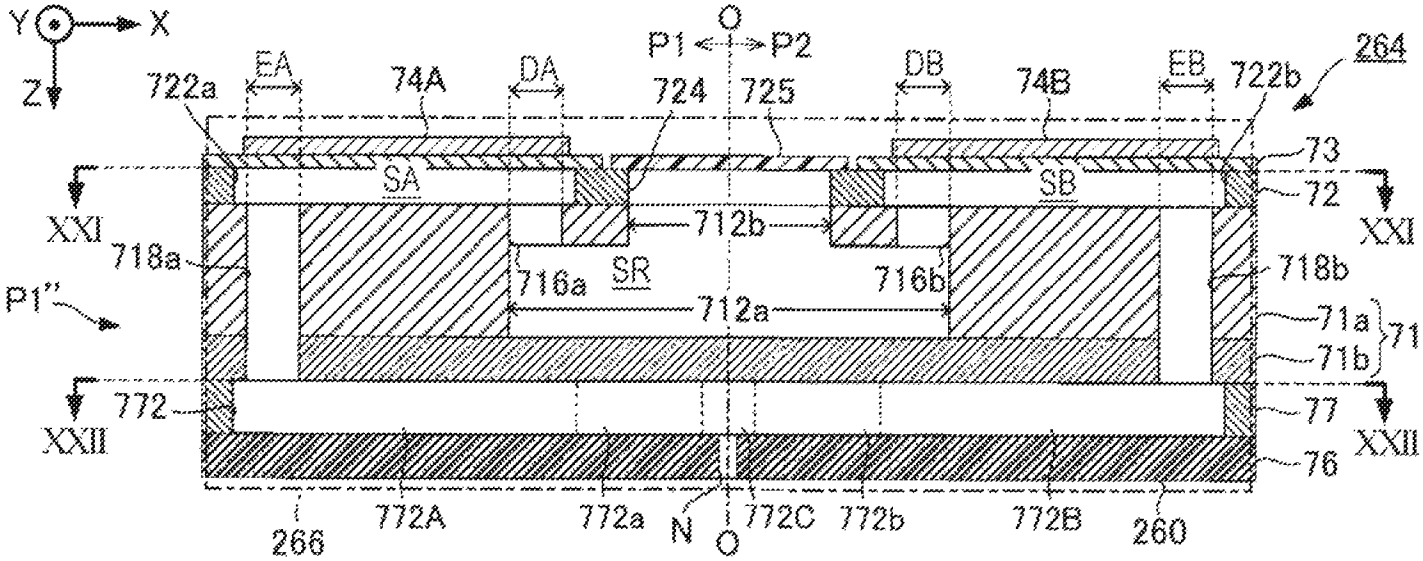
FIG. 19 is a sectional view of the liquid ejecting unit taken along the line XIX-XIX of FIG. 18.
Figure 20:
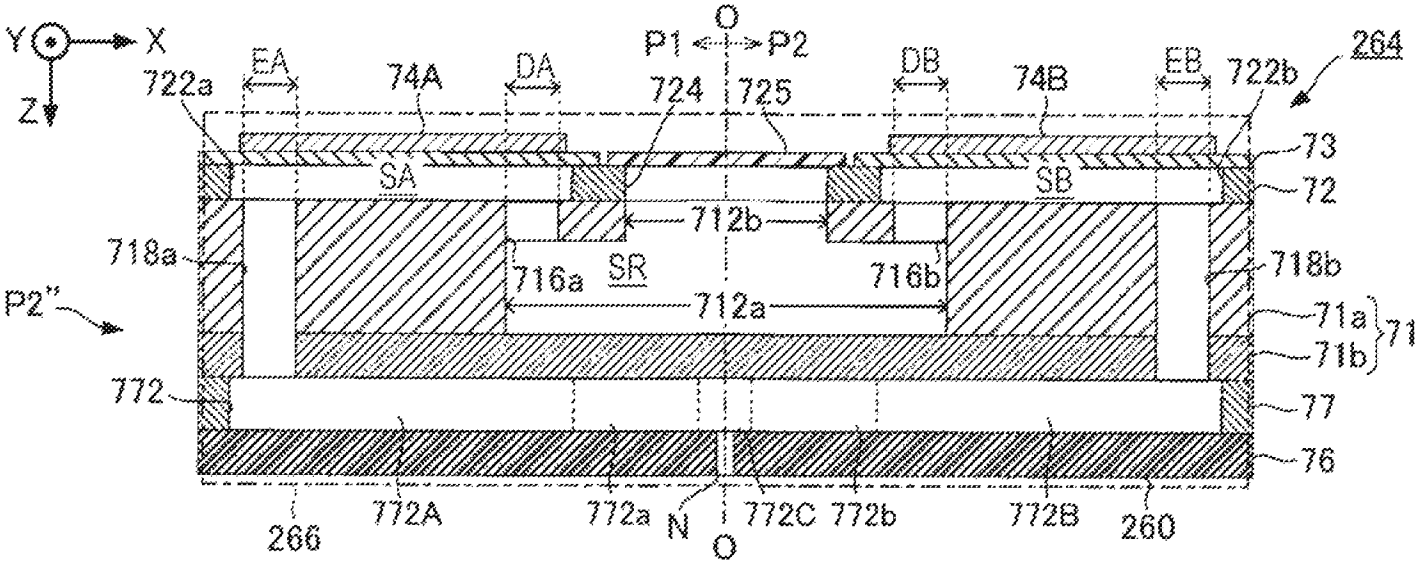
FIG. 20 is a sectional view of the liquid ejecting unit taken along the line XX-XX of FIG. 18.
Figure 21:
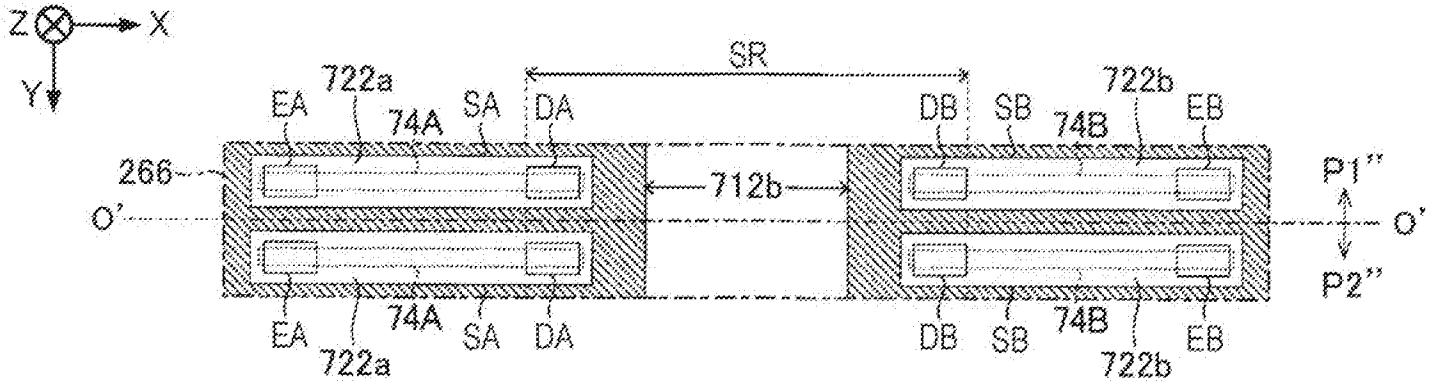
FIG. 21 is a sectional view of an ejector taken along the line XXI-XXI of FIG. 19.
Figure 22:
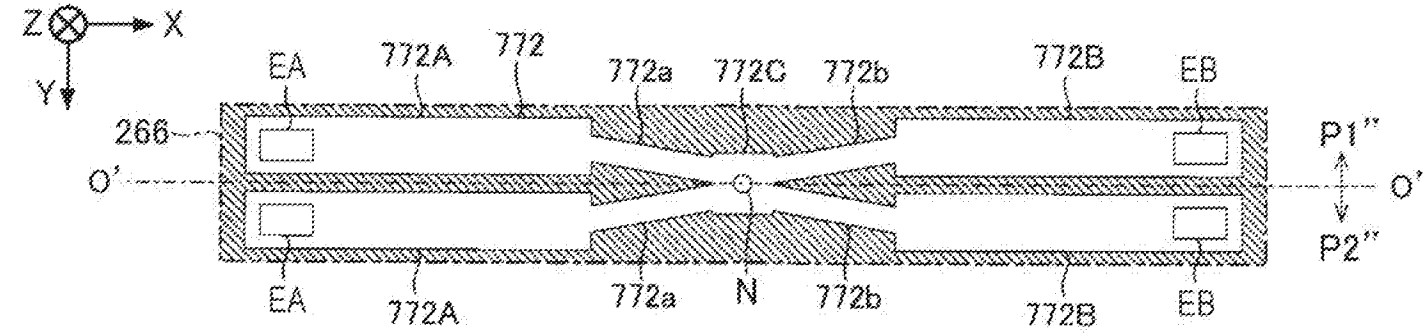
FIG. 22 is a sectional view of the ejector taken along the line XXII-XXII of FIG. 19.

FIG. 18 is a schematic view of the passage structure of the liquid ejecting unit 264, wherein the liquid ejecting head 26 according to the third embodiment is viewed from the negative side in the Z direction. Each of FIGS. 19 and 20 is a diagram that illustrates the structure of the liquid ejecting unit 264 with a focus on arbitrary one of the plurality of ejectors 266. FIG. 19 is a sectional view of the liquid ejecting unit 264 taken along the line XIX-XIX of FIG. 18. FIG. 20 is a sectional view of the liquid ejecting unit 264 taken along the line XX-XX of FIG. 18. FIG. 21 is a sectional view of the ejector 266 taken along the line XXI-XXI of FIG. 19. FIG. 22 is a sectional view of the ejector 266 taken along the line XXII-XXII of FIG. 19.

As illustrated in FIG. 18, in the third embodiment, two first pressure compartments SA are arranged next to each other in the Y direction, and two second pressure compartments SB are arranged next to each other in the Y direction. The liquid ejecting unit 264 illustrated in FIG. 18 is substantially plane-symmetric with respect to a virtual plane O-O that is parallel to the Y-Z plane. The nozzles N are arranged in line along the virtual plane O-O, wherein each of the nozzles N is arranged between the first pressure compartments SA and the second pressure compartments SB in a plan view. Each arbitrary one ejector 266 has a substantially plane-symmetric structure with respect to a virtual plane O'-O' that is parallel to the X-Z plane. Accordingly, the structure of a first structure portion P1", which is located on the negative side in the Y direction with respect to the virtual plane O'-O', is substantially the same as the structure of a second structure portion P2", which is located on the positive side in the Y direction with respect to the virtual plane O'-O'.

As illustrated in the sectional view of FIG. 19, the first structure portion P1" of the ejector 266 has substantially the same structure as that of the first structure portion P1 and the second structure portion P2 illustrated in FIG. 4. Specifically, the first structure portion P1" includes the first piezoelectric element 74A, the diaphragm 73, the first pressure compartment SA, the first passage EA, and the first branch passage DA, and further includes the second piezoelectric element 74B, the diaphragm 73, the second pressure compartment SB, the second passage EB, and the second branch passage DB.

As illustrated in the sectional view of FIG. 20, the second structure portion P2" of the ejector 266 also has substantially the same structure as that of the first structure portion P1 and the second structure portion P2 illustrated in FIG. 4. Specifically, the second structure portion P2" includes the first piezoelectric element 74A, the diaphragm 73, the first pressure compartment SA, the first passage EA, and the first branch passage DA, and further includes the second piezoelectric element 74B, the diaphragm 73, the second pressure compartment SB, the second passage EB, and the second branch passage DB.

As illustrated in FIG. 21, in the pressure compartment substrate 72 according to the third embodiment, two openings 722*a* for configuring two first pressure compartments SA respectively are formed next to each other in the Y direction. In addition, two openings 722*b* for configuring two second pressure compartments SB respectively are formed next to each other in the Y direction. The first pressure compartment SA of the first structure portion P1" is arranged on one side in the X direction with respect to the common liquid chamber SR, the second pressure compartment SB of the first structure portion P1" is arranged on the other side, and the common liquid chamber SR is arranged therebetween in a plan view. The first pressure compartment SA of the second structure portion P2" is arranged on one side in the X direction with respect to the common liquid chamber SR, the second pressure compartment SB of the second structure portion P2" is arranged on the other side, and the common liquid chamber SR is arranged therebetween in a plan view. As illustrated in FIG. 22, which shows the communication passage 772 according to the third embodiment, the passage 772A and the passage 772B of the first structure portion P1" and the passage 772A and the passage 772B of the second structure portion P2" are in communication with the passage 772C, which is in communication with the nozzle N.

In the third embodiment described above, for ink ejection, ejecting drive pulses having the same phase are applied to the first piezoelectric element 74A and the second piezoelectric element 74B of the first structure portion P1" and the first piezoelectric element 74A and the second piezoelectric element 74B of the second structure portion P2". Therefore, it is possible to eject ink that flows from the first piezoelectric element 74A and the second piezoelectric element 74B of the first structure portion P1" and ink that flows from the first piezoelectric element 74A and the second piezoelectric element 74B of the second structure portion P2". For this reason, the amount of ink ejected from the nozzle N is approximately four times as large as the amount of ink that would be ejected if ink flowing from only one first pressure compartment SA or only one second pressure compartment SB were ejected.

For ink circulation, circulating drive pulses having phases different from each other are applied to the first piezoelectric element 74A and the second piezoelectric element 74B of the first structure portion P1" and, in addition, circulating drive pulses having phases different from each other are applied to the first piezoelectric element 74A and the second piezoelectric element 74B of the second structure portion P2". By this means, it is possible to produce a flow of ink that circulates through the communication passage 772 of the nozzle N, the first pressure compartment SA, and the second pressure compartment SB of the first structure portion P1" and produce a flow of ink that circulates through the communication passage 772 of the nozzle N, the first pressure compartment SA, and the second pressure compartment SB of the second structure portion P2".

Similarly to the foregoing embodiments, a single common liquid chamber SR has a dual function, that is, a function of an ink supply passage and a function of an ink circulation passage. Therefore, compared with a structure in which separate common passages are provided for the first pressure compartment SA and the second pressure compartment SB, the circulating passage is shorter. The shorter circulation length reduces passage resistance. For this reason, circulation efficiency improves. The number of the first structure portion P1" and the second structure portion P2" per the ejector 266 may be increased. Since such a modification increases the number of the first pressure compartments SA and the second pressure compartments SB, it is possible to further increase the amount of ink ejected from the nozzle N.

VARIATION EXAMPLES

The exemplary modes and embodiments described above can be modified in various ways. Some specific examples of variation are described below. Any two or more selected from among the exemplary modes/embodiments described above and/or the variation examples described below may be combined as long as they are not contradictory to each other or one another.

(1) In the foregoing embodiments, a serial head that repeats reciprocating movement of the carriage 24, on which the liquid ejecting head 26 is mounted, in the X direction is taken as an example. However, the disclosed technique may be applied to a line head that includes the liquid ejecting head 26 provided linearly over the entire width of the medium 12.

(2) Although the piezoelectric-type liquid ejecting head 26 utilizing, as drive elements, piezoelectric elements that apply mechanical vibration to pressure compartments is disclosed as an example in the foregoing embodiments, a thermal liquid ejecting head utilizing, as drive elements, heat generation elements that produce air bubbles inside pressure compartments by heating may be used instead.

(3) The liquid ejecting apparatus 10 disclosed as examples in the foregoing embodiments can be applied to various kinds of equipment such as facsimiles and copiers, etc. in addition to print-only machines. The scope of application of the liquid ejecting apparatus 10 according to the present disclosure is not limited to printing. For example, a liquid ejecting apparatus that ejects a colorant solution can be used as a manufacturing apparatus for manufacturing a color filter for a liquid crystal display, an organic EL (electroluminescence) display, or an FED (surface emission display), etc. A liquid ejecting apparatus that ejects a solution of a conductive material can be used as a manufacturing apparatus for forming wiring lines and electrodes of a wiring substrate. Another non-limiting example of use is a biochip manufacturing apparatus that ejects a solution of bioorganic substances as a kind of liquid.

The present application is based on, and claims priority from JP Application Serial Number 2018-046862, filed Mar.

14, 2018, the disclosure of which is hereby incorporated by reference herein in its entirety.

What is claimed is:

1. A liquid ejecting head, comprising:

a first nozzle from which a liquid is ejected;

a first communication passage that is in communication with the first nozzle;

a first pressure compartment;

a first drive element that changes a pressure of the first pressure compartment;

a first passage that connects the first pressure compartment and the first communication passage;

a second pressure compartment;

a second drive element that changes a pressure of the second pressure compartment;

a second passage that connects the second pressure compartment and the first communication passage;

a third pressure compartment;

a third drive element that changes a pressure of the third pressure compartment;

a third passage that connects the third pressure compartment and the first communication passage;

a fourth pressure compartment;

a fourth drive element that changes a pressure of the fourth pressure compartment; and a fourth passage that connects the fourth pressure compartment and the first communication passage.

2. The liquid ejecting head according to claim 1, further comprising:

a common liquid chamber that communicates with the first pressure compartment, the second pressure compartment, the third pressure compartment and the fourth pressure compartment, and retains the liquid.

3. The liquid ejecting head according to claim 2, further comprising:

an inlet passage that communicates with the common liquid chamber and supplies that liquid to the common liquid chamber.

4. The liquid ejecting head according to claim 1, wherein the first drive element and the second drive element are piezoelectric elements that are able to cause displacement independently of each other by respective application of drive pulses, and wherein a phase of the drive pulse applied to the second drive element is the same as a phase of the drive pulse applied to the first drive element.

5. The liquid ejecting head according to claim 1, wherein the first drive element and the second drive element are piezoelectric elements that are able to cause displacement independently of each other by respective application of drive pulses, and wherein a phase of the drive pulse applied to the second drive element is different from a phase of the drive pulse applied to the first drive element.

6. A liquid ejecting apparatus, comprising:

the liquid ejecting head according to claim 1.

7. A liquid ejecting apparatus, comprising:

the liquid ejecting head according to claim 2.

8. A liquid ejecting apparatus, comprising:

the liquid ejecting head according to claim 3.

9. A liquid ejecting apparatus, comprising:

the liquid ejecting head according to claim 4.

10. A liquid ejecting apparatus, comprising:

the liquid ejecting head according to claim 5.

11. The liquid ejecting head according to claim 1, wherein the first pressure compartment and the second pressure compartment are arranged side by side in a first direction, and wherein the third pressure compartment and the fourth pressure compartment are arranged side by side in the first direction.

12. The liquid ejecting head according to claim 11, wherein the first pressure compartment and the third pressure compartment are arranged side by side in a second direction that crosses to the first direction, and wherein the second pressure compartment and the fourth pressure compartment are arranged side by side in the second direction.

13. The liquid ejecting head according to claim 1, wherein the first passage and the second passage are arranged side by side in a first direction, and wherein the third passage and the fourth passage are arranged side by side in the first direction.

14. The liquid ejecting head according to claim 13, wherein the first passage and the third passage are arranged side by side in a second direction that crosses to the first direction, and wherein the second passage and the fourth passage are arranged side by side in the second direction.

15. The liquid ejecting head according to claim 14, wherein the first nozzle is positioned between the first passage and the second passage in the first direction, and is positioned between the first passage and the third passage in the second direction.

16. The liquid ejecting head according to claim 1, further comprising a second nozzle from which a liquid is ejected, the second nozzle being different from the first nozzle;

a second communication passage that is in communication with the second nozzle;

a fifth pressure compartment;

a fifth drive element that changes a pressure of the fifth pressure compartment;

a fifth passage that connects the fifth pressure compartment and the second communication passage;

a sixth pressure compartment;

a sixth drive element that changes a pressure of the sixth pressure compartment;

a sixth passage that connects the sixth pressure compartment and the second communication passage;

a seventh pressure compartment;

a seventh drive element that changes a pressure of the seventh pressure compartment;

a seventh passage that connects the seventh pressure compartment and the second communication passage;

an eighth pressure compartment;

an eighth drive element that changes a pressure of the eighth pressure compartment;

an eighth passage that connects the eighth pressure compartment and the second communication passage.

17. The liquid ejecting head according to claim 16, wherein the first pressure compartment and the second pressure compartment are arranged side by side in the first direction, and wherein the third pressure compartment and the fourth pressure compartment are arranged side by side in the first direction, wherein the fifth pressure compartment and the sixth pressure compartment are arranged side by side in the first direction, wherein the seventh pressure compartment and the eighth pressure compartment are arranged side by side in the first direction.

18. The liquid ejecting head according to claim 17, wherein the first pressure compartment, the third pressure compartment, the fifth pressure compartment and the seventh pressure compartment are arranged side by side in the second direction that crosses to the first direction, and wherein the second pressure compartment, the fourth pressure compartment, the sixth pressure compartment and the eighth pressure compartment are arranged side by side in the second direction.

* * * * *